US007388812B2

(12) United States Patent
Nakamura

(10) Patent No.: US 7,388,812 B2
(45) Date of Patent: Jun. 17, 2008

(54) RADIO-CONTROLLED TIMEPIECE AND ELECTRONIC DEVICE, CONTROL METHOD FOR A RADIO-CONTROLLED TIMEPIECE, AND RECEPTION CONTROL PROGRAM FOR A RADIO-CONTROLLED TIMEPIECE

(75) Inventor: Hidenori Nakamura, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 203 days.

(21) Appl. No.: 10/955,861

(22) Filed: Sep. 29, 2004

(65) Prior Publication Data

US 2005/0157592 A1 Jul. 21, 2005

(30) Foreign Application Priority Data

Sep. 30, 2003 (JP) ..... 2003-340471

(51) Int. Cl.
*G04C 11/02* (2006.01)

(52) U.S. Cl. ..... 368/47

(58) Field of Classification Search ..... 368/47, 368/46, 52, 53, 55–59
See application file for complete search history.

(56) References Cited

U.S. PATENT DOCUMENTS 5,089,814 A * 2/1992 DeLuca et al. ..... 340/825.49
5,886,954 A * 3/1999 Asami et al. ..... 368/67
6,320,822 B1 11/2001 Okeya et al.
7,079,451 B2 * 7/2006 Okeya ..... 368/47
2002/0181333 A1 * 12/2002 Ito et al. ..... 368/21
2003/0002392 A1 * 1/2003 Klein et al. ..... 368/184
2003/0117903 A1 * 6/2003 Nakajima et al. ..... 368/47
2003/0198140 A1 * 10/2003 Shimizu ..... 368/47
2004/0233789 A1 * 11/2004 Oguchi et al. ..... 368/47

FOREIGN PATENT DOCUMENTS

| | | |
|---|---|---|
| JP | 07-159555 | 6/1995 |
| JP | 07-198876 | 8/1995 |
| JP | 2000-221284 | 8/2000 |
| JP | 2000-266872 | 9/2000 |
| JP | 2001-166071 | 6/2001 |
| JP | 2002-139586 | 5/2002 |
| JP | 2003-139875 | 5/2003 |
| WO | WO99/27423 | 6/1999 |
| WO | WO 03/107100 | 12/2003 |

* cited by examiner

*Primary Examiner*—Thanh S Phan

(57) ABSTRACT

A motion detection means 5 has a power generation detection circuit 51 for detecting the output voltage of a generating means 4, and a decision unit 52 for determining if the radio-controlled timepiece 1 is moving based on the output voltage from the power generation detection circuit 51. If when a standard time signal is to be received by means of a receiver 2 the not_moving detection signal indicating that the radio-controlled timepiece 1 is not moving is output from the motion detection means 5, the reception operation is executed and the time displayed on the time display means 3 is adjusted. By receiving the standard time signal when the radio-controlled timepiece 1 is not moving, accurate time information can be received and the reliability of standard time signal reception can be improved because the reception success rate is also improved.

25 Claims, 21 Drawing Sheets

RADIO-CONTROLLED TIMEPIECE AND ELECTRONIC DEVICE, CONTROL METHOD FOR A RADIO-CONTROLLED TIMEPIECE, AND RECEPTION CONTROL PROGRAM FOR A RADIO-CONTROLLED TIMEPIECE

BACKGROUND OF THE INVENTION

1. Field of Technology

The present invention relates to a radio-controlled timepiece, an electronic device having a radio-controlled timepiece, a method of controlling a radio-controlled timepiece, and a reception control program for a radio-controlled timepiece.

2. Description of Related Art

Radio-controlled timepieces, which receive a standard time signal carrying time information, include timepieces that automatically unconditionally receive the standard time signal according to a predetermined schedule, and timepieces that detect movement of the timepiece and receive the standard time signal accordingly.

More specifically, Japanese Patent 3313215, for example, teaches a radio-controlled timepiece that detects if the timepiece is being worn or carried and receives the standard time signal while the radio-controlled timepiece is moving (see, for example, pages 5 to 7 and FIG. 1). This radio-controlled timepiece has a power conservation function that stops driving the timepiece when the timepiece is not being carried, and does not receive the standard time signal when the timepiece is not moving. When the timepiece detects a change from the not-worn (non-moving) mode to the worn (moving) mode and resumes the normal drive mode from the power conservation mode, the timepiece immediately forces reception of the standard time signal and corrects the displayed time. This radio-controlled timepiece can thus eliminate receiving the standard time signal when the radio-controlled timepiece is not being used, and thus reduce power consumption by the radio-controlled timepiece.

In addition, Japanese Unexamined Patent Application 2000-221284 teaches a radio-controlled timepiece that receives the standard time signal when the timepiece is not moving because reception is difficult when the timepiece is moving. This radio-controlled timepiece is used in an automobile, for example, and receives the radio signal when the vehicle ignition switch is off or the accessory switch is on. Stable signal reception may not be possible when the ignition switch is on due to interference from vehicle engine noise or because the vehicle is moving, but this radio-controlled timepiece improves reception stability by receiving the signal when the vehicle is stopped.

Japanese Unexamined Patent Appl. Pub. 2001-166071 teaches a radio-controlled timepiece that has a power generating means and prohibits receiving a radio signal while the power generating means is producing power. The generating means in this radio-controlled timepiece has a rotor, stator, and generating coil, and derives power by means of electromagnetic induction. The effects of electromagnetic noise produced when the generating means is producing power can interfere with normal signal reception when the generating means is producing power. However, by preventing signal reception while power is being generated by the generating means, this radio-controlled timepiece can correctly receive the standard time signal.

The radio-controlled timepiece that receives a signal while the timepiece is being worn must, however, be able to receive the signal while the timepiece is moving. However, while this radio-controlled timepiece can receive the standard time signal under certain circumstances while the timepiece is moving, the signal cannot be received if the timepiece moves to a location where the standard time signal cannot be received, for example. It therefore cannot be assumed that this radio-controlled timepiece can always reliably receive the standard time signal.

Furthermore, because the standard time signal is received and the time is adjusted when a change from a stationary to a moving state is detected, the power conservation mode is cancelled and the standard time signal is unconditionally received when the radio-controlled timepiece is picked up to be worn. However, reception may or may not succeed at this time depending upon the location where reception is attempted and the orientation of the bar antenna of the timepiece, and the correct time may not be displayed. If the signal cannot be correctly received at this time, the power supply of the radio-controlled timepiece is needlessly drained, and power conservation cannot be improved for the radio-controlled timepiece.

Another type of radio-controlled timepiece having a power conservation mode automatically receives and adjusts the time according to a predetermined schedule without driving the timekeeping mechanism when the power conservation mode is active. As a result, this radio-controlled timepiece can display the time relatively accurately even if signal reception fails after cancelling the power conservation mode because the standard time signal is received on a regular schedule even while the power conservation mode is active.

However, this type of radio-controlled timepiece consumes more power than the previous radio-controlled timepiece because the standard time signal is received even when the power conservation mode is active, and power consumption by the timepiece is not particularly reduced. Furthermore, if the radio-controlled timepiece is left in a location where the standard time signal cannot be received, this timepiece will automatically repeatedly attempt to receive the standard time signal at the scheduled reception time even while the power conservation mode is active, and power conservation by the radio-controlled timepiece cannot be improved.

Yet further, if the radio-controlled timepiece that receives the standard time signal when the timepiece is not moving is in an automobile and the automobile is not moving but the standard time signal cannot be correctly received because the vehicle is stopped in the midst of tall buildings, for example, standard time signal reception may succeed or fail even though reception is controlled based on detection of movement, and reliable reception therefore may not be assured. Improving power conservation in such radio-controlled timepieces may therefore not be possible in such timepieces because of such wasted attempts to receive the standard time signal.

The foregoing radio-controlled timepiece that prohibits reception while the generating means is producing power prohibits receiving the standard time signal while the timepiece is moving. The standard time signal is therefore normally received when the radio-controlled timepiece is not being worn. However, if the timepiece is located where standard time signal reception is poor, such as inside an office building, the timepiece may not be able to receive the time signal correctly. Such reception control cannot assure sufficient reception reliability and results in needless reception operations, and improved power conservation thus also cannot be provided with this type of radio-controlled timepiece.

The foregoing radio-controlled timepieces can thus receive the standard time signal while the timepiece is moving or can receive the standard time signal while the power conservation mode is active, and can thus successfully receive the standard time signal under certain circumstances. However, reception is not possible in some situations, such as when the radio-controlled timepiece is in a location where the standard time signal cannot reach, and these radio-controlled timepieces therefore lack sufficiently reliable signal reception. As a result, these radio-controlled timepieces consume much power when reception is attempted where the standard time signal cannot be received. Furthermore, because receiving the standard time signal consumes much more power than does simply driving the timekeeping mechanism, power consumption due to needless reception attempts is a particularly significant drawback.

An object of the present invention is therefore to provide a radio-controlled timepiece that can promote power conservation and improve the reliability of external signal reception. A further object of the invention is to provide an electronic device incorporating this radio-controlled timepiece, a control method for the radio-controlled timepiece, and a reception control program for the radio-controlled timepiece.

SUMMARY OF THE INVENTION

A radio-controlled timepiece according to the present invention is a radio-controlled timepiece having a time display means for displaying time based on a reference signal, and adjusting the time displayed by the time display means based on an external signal containing time information, said radio-controlled timepiece having a reception unit for receiving the external signal; a location detection means for detecting the current location of the radio-controlled timepiece and outputting a location detection signal indicating if the radio-controlled timepiece is located where the external signal can be received or is located where the external signal cannot be received; and a control means for controlling operation of the reception unit, the control means comprising a reception operation control means for controlling the reception operation of the reception unit based on the radio-controlled timepiece location detection signal output from the location detection means.

Because the location detection means determines if the radio-controlled timepiece is located where an external signal can be received when the reception unit is to receive the external signal, a location detection signal indicating that the radio-controlled timepiece is located where the external signal can be received is output when the radio-controlled timepiece is located in a place where the external signal can be easily received, such as outdoors or near a window. When the timepiece is in a location where receiving the external signal is difficult, such as inside a building or between tall buildings in a city, a location detection signal indicating that the timepiece is located where the external signal cannot be received is output.

External signals can thus be received more accurately and reception reliability can be improved because the control means has a reception operation control means that controls reception by the reception unit based on the radio-controlled timepiece location detection signal from the location detection means so that, for example, the external signal is received only when a location detection signal indicating that the radio-controlled timepiece is located where reception is possible is output from the location detection means. Furthermore, because whether the timepiece is located where reception is possible is detected by the location detection means and external signals are received based on the resulting detection signal, wasteful reception attempts are prevented and power consumption by the radio-controlled timepiece is reduced.

The current location of the radio-controlled timepiece is also not limited to the place where the timepiece is placed on top of a desk or beside a window, for example, and specifically includes the location of the radio-controlled timepiece when the radio-controlled timepiece is worn. When the radio-controlled timepiece is worn, the current location of the radio-controlled timepiece means wherever the radio-controlled timepiece is. Furthermore, a receivable location for the radio-controlled timepiece means a place near an opening through which the external signal can pass, such as an exterior window of a building when the radio-controlled timepiece is inside a building.

Preferably, the location detection means outputs a receivable_location detection signal as the location detection signal if the radio-controlled timepiece is determined to be located where the external signal can be received, and outputs an out_of_reception_range detection signal as the location detection signal if the radio-controlled timepiece is determined to be located where the external signal cannot be received; and the control means comprises a reception driving means for executing the reception operation of the reception unit if the receivable_location detection signal is output from the location detection means, and a reception blocking means for blocking the reception operation of the reception unit if the out_of_reception_range detection signal is output, when the reception unit receives the external signal.

Thus comprised, the location detection means decides if the radio-controlled timepiece is located where the external signal can be received before the reception unit starts receiving the external signal. Therefore, if the radio-controlled timepiece is determined to be located where receiving the external signal is difficult, such as inside a building or between tall buildings in a city, the out_of_reception_range detection signal is output and reception is not attempted. Because the control means detects the current location of the radio-controlled timepiece and does not receive the external signal if reception is difficult, the reliability of external signal reception can be further improved, wasteful reception operations are prevented, and power consumption by the radio-controlled timepiece is reduced.

Yet further preferably, the location detection means outputs a receivable_location detection signal as the location detection signal if the radio-controlled timepiece is determined to be located where the external signal can be received, and outputs an out_of_reception_range detection signal as the location detection signal if the radio-controlled timepiece is determined to be located where the external signal cannot be received; and the control means comprises a reception operation stopping means for stopping the reception operation of the reception unit if the out_of_reception_range detection signal is received from the location detection means while the external signal is being received by the reception unit.

When the radio-controlled timepiece is worn, the radio-controlled timepiece could move indoors where receiving the external signal is difficult while the signal is being received. Accurately receiving the signal may not be possible if the radio-controlled timepiece is located where external signal reception is difficult, and because the external signal reception operation of the reception unit and the time adjustment operation of the control means consume more power than is needed to normally drive the time display means, reception will be wasted and the power needed for reception will be needlessly consumed when the timepiece is located where reception is difficult.

With this aspect of the invention, however, the control means stops the external signal reception operation of the reception unit if the out_of_reception_range detection signal is output by the location detection means while the external signal is being received. Power consumption by the radio-controlled timepiece due to wasteful reception operations can thus be prevented.

Further preferably, the radio-controlled timepiece also has a photoelectric generating means for producing power by converting light energy to electrical energy. The location detection means outputs a receivable_location detection signal as the location detection signal if the radio-controlled timepiece is determined to be located where the external signal can be received, outputs an out_of_reception_range detection signal as the location detection signal if the radio-controlled timepiece is determined to be located where the external signal cannot be received, and outputs the receivable_location detection signal to the control means when power output by the photoelectric generating means is greater than or equal to a specific value, and otherwise outputs the out_of_reception_range detection signal.

External signals such as longwave standard time signals can also reach locations that are relatively easily reached by sunlight, such as outdoors and indoors beside a window. Using this tendency, the location detection means determines that reception is possible and outputs the receivable_location detection signal if the power output from the photoelectric generating means is greater than or equal to a specific value. Because the location detection means detects the current location of the radio-controlled timepiece using information about power generation by the photoelectric generating means used to generate operating power for the timepiece, the arrangement of the location detection means is simplified and the parts count of the radio-controlled timepiece is reduced.

Yet further preferably, the location detection means comprises a day/night determination means for determining if the current time is during day or during night based on current time information from the control means, and a threshold value setting means for changing the threshold value for radio-controlled timepiece location detection based on the day/night determination from the day/night determination means.

If the location detection means uses a photoelectric generating means and the primary light source is sunlight, the ambient luminance differs significantly between day and night, and power output differs accordingly. The day/night determination means of the location detection means in this aspect of the invention, however, determines whether it is day or night based on current time information from the control means, and can change the threshold values used at day and night by the decision unit of the location detection means according to the day/night determination. The location can thus be detected using parameters better suited to the actual conditions, and thus more accurately detecting the location affords more reliable reception of external signals by the reception unit.

Further preferably, the radio-controlled timepiece also has a motion detection means for detecting if the radio-controlled timepiece is moving, outputting a motion detection signal if the radio-controlled timepiece is determined to be moving, and outputting a not_moving detection signal if the radio-controlled timepiece is determined to be stationary. The location detection means outputs a receivable_location detection signal as the location detection signal if the radio-controlled timepiece is determined to be located where the external signal can be received, and outputs an out_of_reception_range detection signal as the location detection signal if the radio-controlled timepiece is determined to be located where the external signal cannot be received. The control means comprises a reception driving means for executing the reception operation of the reception unit if the receivable_location detection signal is output from the location detection means and the not_moving detection signal is output from the motion detection means when the reception unit receives the external signal.

The motion detection means in this aspect of the invention detects if the radio-controlled timepiece is moving or stationary. More specifically, if the radio-controlled timepiece is a wristwatch, for example, and the radio-controlled timepiece is worn by the user and thus moves, the motion detection means detects this movement and outputs the motion detection signal. If the radio-controlled timepiece is not worn by the user and is left somewhere, the motion detection means outputs the not_moving detection signal because the radio-controlled timepiece is not moving.

The control means outputs a command to the reception unit to receive the external signal when the not_moving detection signal is received from the motion detection means in addition to the receivable_location detection signal from the location detection means. The reception unit receives this command and then receives the external signal.

Before receiving an external signal, the motion detection means detects if the radio-controlled timepiece is moving, and external signal reception begins if the receivable_location detection signal is output from the location detection means and the timepiece is determined to not be moving based on the not_moving detection signal output from the motion detection means. Signal reception is thus more accurate and reliable because the orientation and attitude of the reception unit does not change and reception performance is stable. Furthermore, because reception is not attempted if the determination is that the external signal cannot be accurately received, power consumption by the radio-controlled timepiece due to wasteful reception is reduced and energy efficiency is improved.

Movement of the radio-controlled timepiece is not limited to movement due to the radio-controlled timepiece being worn as described above, and other situations in which the radio-controlled timepiece might move include when the location of the timepiece is changed or the timepiece is installed in a motor vehicle and the location of the timepiece changes as the vehicle moves. Movement of the radio-controlled timepiece thus means any condition in which the orientation or position of the radio-controlled timepiece changes relative to the transmission source of the external signal.

Further preferably, the radio-controlled timepiece also has a motion detection means for detecting if the radio-controlled timepiece is moving, outputting a motion detection signal if the radio-controlled timepiece is determined to be moving, and outputting a not_moving detection signal if the radio-controlled timepiece is determined to be stationary; and the control means comprises a reception operation stopping means for stopping the reception operation of the reception unit if the motion detection signal is received from the motion detection means while the external signal is being received by the reception unit.

The motion detection means in this aspect of the invention detects movement of the radio-controlled timepiece. If the radio-controlled timepiece is a wristwatch, for example, and the radio-controlled timepiece moves because the user is wearing the timepiece, the motion detection means detects this movement and outputs the motion detection signal. If the radio-controlled timepiece is not being worn by the user and is placed somewhere, the motion detection means outputs the not_moving detection signal because the radio-controlled timepiece is not moving. If the motion detection means outputs the motion detection signal while the reception unit is receiving the external signal, reception is stopped even though the reception unit is receiving the signal.

Because the radio signal might not be accurately received if the radio-controlled timepiece is moved while the external-signal is being received, and because the external signal reception operation of the reception unit and the time adjustment operation of the control means consume more power than is needed to normally drive the time display means, the power needed for reception may be needlessly consumed if the timepiece is moved while the signal is being received.

When the motion detection signal is output from the motion detection means, the control means receives the motion detection signal and stops the reception operation of the reception unit in this aspect of the invention, thereby reducing power consumption by the radio-controlled timepiece. Battery life can thus be extended when a battery is used to drive the reception unit. The reception reliability of the radio-controlled timepiece is also improved because the possibility of receiving inaccurate time information is reduced.

Yet further preferably, the radio-controlled timepiece also has a generating means for producing power by converting external energy to electrical energy; and the motion detection means comprises a power generation detection means for detecting the generating status of the generating means, and a decision unit for determining if the radio-controlled timepiece is moving or not based on the detection signal from the power generation detection means.

When the power generating means produces electricity in conjunction with the radio-controlled timepiece being worn by a user, such as when the power generating means uses a rotary pendulum, or the power output of the power generating means varies as a result of movement resulting from the radio-controlled timepiece being worn, such as with a photoelectric generating means, the power output of the generating means often changes when the radio-controlled timepiece moves. With this aspect of the invention, however, the power generation detection means of the motion detection means detects the power output of the generating means, and the decision unit monitors the power output. Information about power generation by the generating means can thus be used to detect movement of the radio-controlled timepiece. Furthermore, because the motion detection means detects movement of the radio-controlled timepiece using the generating means provided for generating drive power for the timepiece, the construction of the radio-controlled timepiece is simplified and the parts count reduced. Furthermore, also using the photoelectric generating means in the location detection means yet further reduces the parts count of the radio-controlled timepiece and thus the manufacturing cost, and is thus particularly effective.

Yet further preferably, the generating means is a photoelectric generating means for producing power by converting light energy to electrical energy; and the motion detection means comprises an output unit for outputting the not_moving detection signal if the average variation in the power output of the generating means is within a specific range for a specific time, and otherwise outputting the motion detection signal.

When generating means is a photoelectric generating means as in this aspect of the invention, power output by the generating means is substantially constant when the radio-controlled timepiece is not moving, such as when the timepiece is not being worn or used, because the generating means is exposed to substantially uniform light. Using this characteristic of substantially constant power output information, the motion detection means determines that the radio-controlled timepiece is not moving and outputs the not_moving detection signal when the average variation in power output is within a specific range for a specific time. Furthermore, because the motion detection means uses information that can be easily acquired from the photoelectric generating means, the configuration of the motion detection means is simplified and determining whether the timepiece is moving or not moving is more dependable.

Furthermore, also using the photoelectric generating means in the location detection means yet further reduces the parts count of the radio-controlled timepiece and thus the manufacturing cost, and is thus particularly effective.

Further preferably, the generating means is a photoelectric generating means for producing power by converting light energy to electrical energy; and the motion detection means comprises an output unit for outputting the not_moving detection signal if variation in the power output of the generating means is within a specific range for a specific time, and otherwise outputting the motion detection signal.

Motion detection is even more reliable in this aspect of the invention because the motion detection means outputs the motion detection signal if the change in power output by the generating means exceeds a specific range even only once during the specific time. Furthermore, because measuring the power output of the generator stops as soon as motion is detected, motion detection consumes less power than motion detection based on calculating the average variation in power output. The motion detection means is also simplified because there is no need to calculate the average variation in power output.

In another aspect of the invention the power generating means is an electromechanical generating means for producing power by converting mechanical energy resulting from the radio-controlled timepiece being worn to electrical energy; and the motion detection means comprises an output unit for outputting the not_moving detection signal if the power output of the generating means is less than or equal to a specific value at a specific time, and otherwise outputting the motion detection signal.

Power output from the generating means is substantially zero in this aspect of the invention when the radio-controlled timepiece is not worn or used and is thus not moving because the generating means is an electromechanical generating means that produces power from the mechanical energy produced by wearing and moving the radio-controlled timepiece. Using this information that power output goes substantially to zero when the timepiece is not moving, the motion detection means determines that the radio-controlled timepiece is not moving and outputs the not_moving detection signal when power output is less than or equal to a specific value for a specific time. Furthermore, the configuration of the motion detection means is simplified because the motion detection means uses power output information that is easily acquired from the generating means. The decision unit also only needs to decide if power output is less than or equal to a specified value for a specified time. The decision unit is thus also simplified, and the moving/not-moving determination is more dependable.

In another aspect of the present invention, the motion detection means comprises an attitude change detection means for detecting a change in the attitude of the radio-controlled timepiece, and a decision unit for determining if the radio-controlled controlled timepiece is moving based on the detection signal from the attitude change detection means.

When the radio-controlled timepiece is worn by a user and the attitude of the radio-controlled timepiece thus changes, the attitude change detection means in this aspect of the invention detects this change in attitude. If the decision unit determines that the radio-controlled timepiece is moving based on the change in attitude, the motion detection means outputs the motion detection signal to the control means. Furthermore, because change in attitude is directly detected as a parameter for detecting movement of the radio-controlled timepiece, the threshold values and conditions used by the decision unit can be set more easily, and the arrangement of the decision unit is simplified.

The motion detection means yet further preferably has a reception operation linking means that operates in conjunction with the external signal reception operation of the reception unit.

That the motion detection means thus operates in conjunction with the reception operation of the reception unit means that, for example, the motion detection means operates immediately before the reception operation of the reception unit or operates at a specific time after the reception operation starts (that is, during reception).

Because the motion detection means operates in conjunction with the reception operation of the reception unit in this aspect of the invention, whether the radio-controlled timepiece is moving is detected immediately before or during standard time signal reception, and the reception operation is determined based on more accurate motion detection. The reception reliability of the radio-controlled timepiece is thus further improved. Power consumption is also reduced because the motion detection means only operates when required for reception.

An electronic device according to another aspect of the invention comprises any of the foregoing radio-controlled timepieces of this invention.

By thus comprising a radio-controlled timepiece as described above, an electronic device according to the present invention has the same effects as the foregoing radio-controlled timepieces. More specifically, reception of external signals is more assured and the reliability of external signal reception is improved because the location of the electronic device is detected by the location detection means and whether to receive the external signal is determined based on this location detection signal. Furthermore, because external signals are received based on the current location detection signal of the electronic device output by the location detection means, wasted reception operations are prevented and the power consumption of the electronic device is reduced.

A control method for a radio-controlled timepiece according to another aspect of the invention is a control method for a radio-controlled timepiece that adjusts the displayed time based on an external signal containing time information, the control method having: a location detection step of detecting the current location of the radio-controlled timepiece and outputting a location detection signal indicating if the radio-controlled timepiece is located in a position where the external signal can be received or is located in a position where the external signal cannot be received; a reception step of receiving the external signal; and a time adjustment step of adjusting the displayed time based on time information in the external signal received in the reception step; wherein the reception step has a reception operation control routine for controlling receiving the external signal based on the radio-controlled timepiece location detection signal output in the location detection step when the external signal is received.

If the radio-controlled timepiece is a wristwatch, for example, and is worn in a place where the external signal can be easily received, such as outdoors or near a window, a location detection signal indicating that the radio-controlled timepiece is located where the external signal can be received is output to the control means in the location detection step. If the user is wearing the watch where receiving the external signal is difficult, such as inside a building, a location detection signal indicating that the timepiece is located where reception is not possible is output to the control means.

An external signal containing time information is received in the reception step, and receiving the external signal is controlled based on the location detection signal output in the location detection step. The time adjustment step then adjusts the displayed time based on the time information in the external signal.

The reliability of external signal reception is thus improved and the reception performance of the radio-controlled timepiece is more stable and reception precision is improved because reception in the reception step is based on the location detection signal output in the location detection step. The time displayed by the radio-controlled timepiece is thus accurate.

Wasted reception operations are also prevented in locations where receiving the external signal is difficult, power consumption by the radio-controlled timepiece is thus reduced, and energy efficiency is improved because external signal reception is controlled based on the location detection signal output in the location detection step.

In another aspect of the present invention the location detection step comprises a receivability determination signal output routine that outputs a receivable_location detection signal as the location detection signal if the radio-controlled timepiece is determined to be located in a position where the external signal can be received, and outputs an out_of_reception_range detection signal as the location detection signal if the radio-controlled timepiece is determined to be located in a position where the external signal cannot be received; and the reception step has a reception operation routine for receiving the external signal if the receivable_location detection signal is output for the radio-controlled timepiece in the location detection step.

Because whether the radio-controlled timepiece is located where the external signal can be received is first determined by the location detection step, the out_of_reception_range detection signal is output and reception is not attempted if the radio-controlled timepiece is determined to be located where receiving the external signal is difficult, such as between tall buildings in a city or inside a building. More specifically, because the reception step receives the external signal if the receivable_location detection signal is output in the location detection step, reception performance is stable and the reliability of external signal reception is further improved. Unnecessary reception attempts are also eliminated, and power consumption by the radio-controlled timepiece is reduced.

In a yet further aspect of the invention, the location detection step has a receivability determination signal output routine that outputs a receivable_location detection signal as the location detection signal if the radio-controlled timepiece is determined to be located in a position where the external signal can be received, and outputs an out_of_reception_range detection signal as the location detection signal if the radio-controlled timepiece is determined to be located in a position where the external signal cannot be received; and the reception step has a reception stopping routine for stopping the reception operation if the out_of_reception_range detection signal is output for the radio-controlled timepiece in the location detection step while the external signal is being received.

If a radio-controlled timepiece is worn or carried and moves indoors while the external signal is being received, continuing to receive the external signal may become difficult. Accurately receiving the signal may not be possible if the radio-controlled timepiece is located where external signal reception is difficult, and because the external signal reception operation of the reception unit and the time adjustment operation of the control means consume more power than is needed to normally drive the time display means, reception will be wasted and the power needed for reception will be needlessly consumed when the timepiece is located where reception is difficult.

However, because the reception step has a reception stopping routine in this aspect of the invention, the external signal reception operation of the reception unit is stopped if the out_of_reception_range detection signal is output in the location detection step while the external signal is being received. Power consumption by the radio-controlled timepiece due to wasteful reception operations can thus be prevented.

A radio-controlled timepiece control method according to a further aspect of the invention also has a motion detection step of detecting if the radio-controlled timepiece is moving, outputting a motion detection signal if the radio-controlled timepiece is determined to be moving, and outputting a not_moving detection signal if the radio-controlled timepiece is determined to not be moving; the location detection step has a receivability determination signal output routine that outputs a receivable_location detection signal as the location detection signal if the radio-controlled timepiece is determined to be located in a position where the external signal can be received, and outputs an out_of_reception_range detection signal as the location detection signal if the radio-controlled timepiece is determined to be located in a position where the external signal cannot be received; and the reception step comprises a reception operation routine for receiving the external signal if the receivable_location detection signal is output in the location detection step and the not_moving detection signal is output in the motion detection step when the external signal is to be received.

If the radio-controlled timepiece is a wristwatch, for example, and the radio-controlled timepiece moves as a result of the radio-controlled timepiece being worn by a user, the motion detection step detects this movement and outputs the motion detection signal. Furthermore, if the user is not wearing the radio-controlled timepiece and places the timepiece somewhere, the radio-controlled timepiece is stationary, and the motion detection step outputs the not_moving detection signal.

Although an external signal containing time information is received in the reception step, reception occurs when the not_moving detection signal is output in the motion detection step in addition to detection of the current location of the radio-controlled timepiece in the location detection step. Because the external signal is received when there is no movement of the radio-controlled timepiece, there is no change in the orientation or attitude of the reception unit, reception performance is thus more stable, and external signal reception is more assured and accurate. As a result, the reliability of reception by the radio-controlled timepiece is yet further improved. In addition, because wasted reception attempts are avoided by determining when the external signal cannot be accurately received, power consumption by the radio-controlled timepiece is reduced and energy efficiency is improved.

A reception control program for a radio-controlled timepiece according to a further aspect of the invention is a reception control program causing a computer, which is incorporated in a radio-controlled timepiece having a reception unit for receiving an external signal carrying time information and a time display means for displaying the time based on a reference signal, to function as a control means having a location detection means for detecting the current location of the radio-controlled timepiece and outputting a location detection signal indicating if the radio-controlled timepiece is located where the external signal can be received or is located where the external signal cannot be received. The control means also controls operation of the time display means, and controls the reception operation of the reception unit based on the radio-controlled timepiece location detection signal from the location detection means.

This aspect of the invention affords the same effects as a radio-controlled timepiece described above according to the present invention, promotes power conservation by the radio-controlled timepiece, and improves reception reliability.

DESCRIPTION OF THE PREFERRED EMBODIMENTS

Embodiment 1

A first preferred embodiment of the present invention is described below with reference to the accompanying figures.

Figure 1:
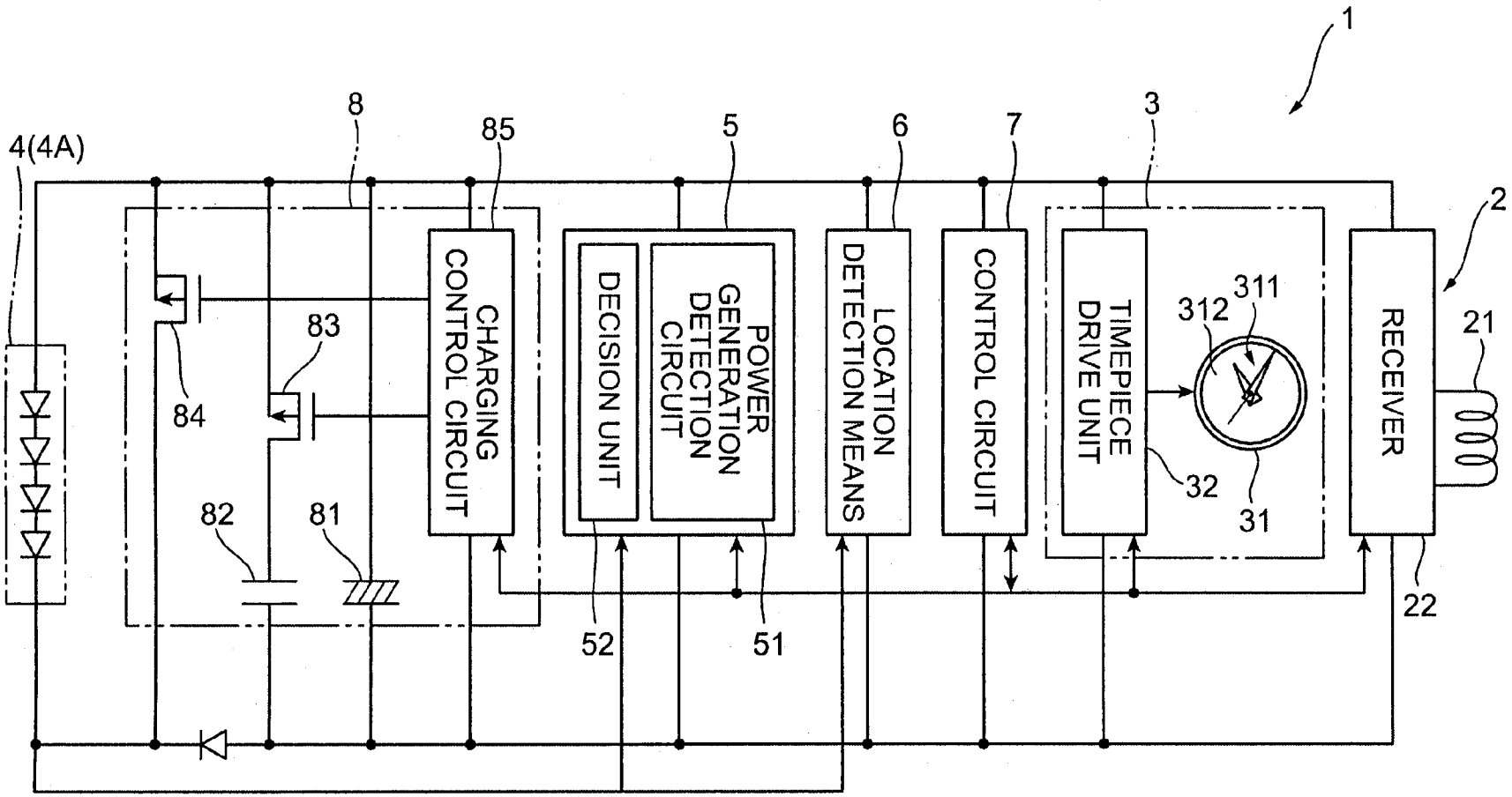
FIG. 1 is a function block diagram of a radio-controlled timepiece according to a first embodiment of the present invention.
Figure 2:
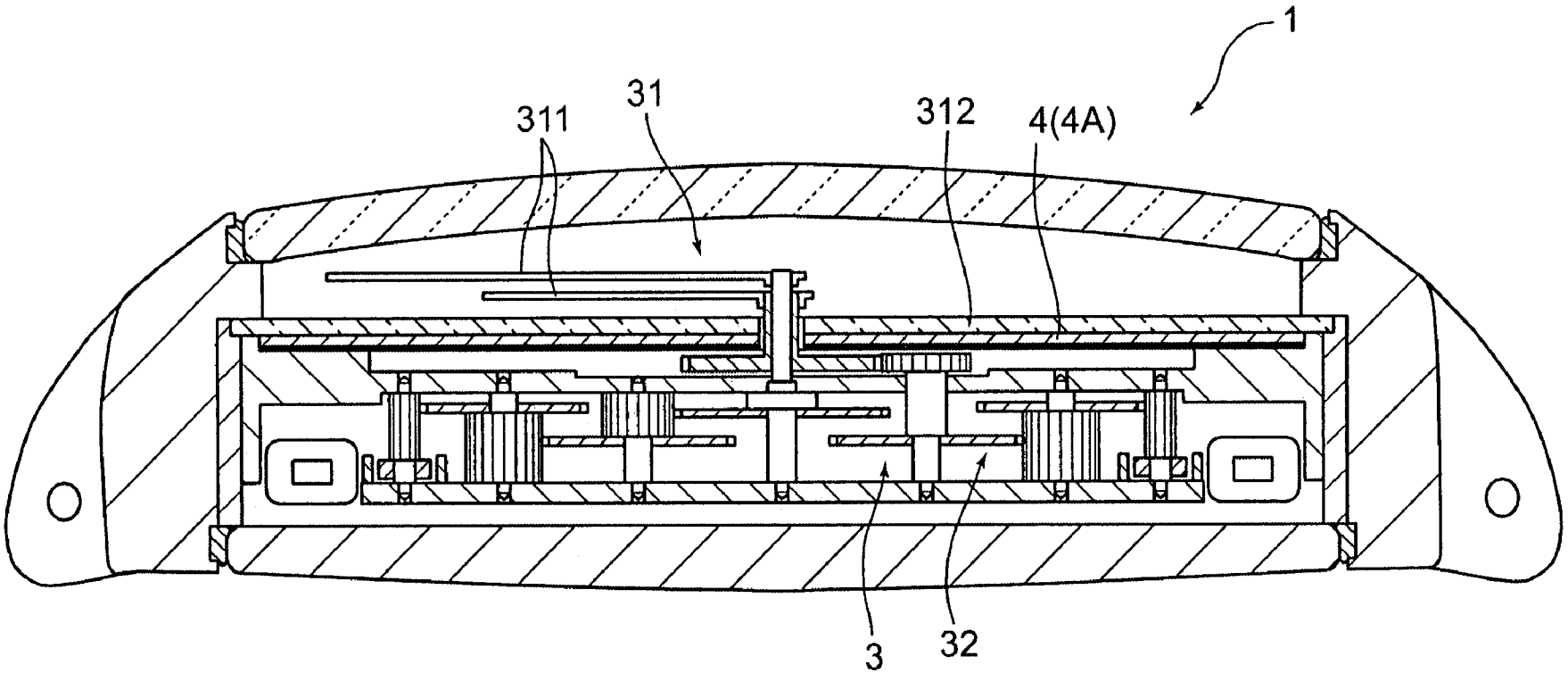
FIG. 2 is a side section view of the radio-controlled timepiece according the first embodiment of the invention.

FIG. 1 is a function block diagram of a radio-controlled timepiece 1 according to a first embodiment of the present invention. FIG. 2 is a side section view of the radio-controlled timepiece 1. A radio-controlled timepiece 1 according to this embodiment of the invention is a radio-controlled timepiece that adjusts the displayed time based on a standard time signal (external signal) carrying superimposed time information broadcast from an external source, and more specifically is a wristwatch that can be worn by a user.

As shown in FIG. 1 and FIG. 2, this radio-controlled timepiece 1 has a receiver 2 for receiving a standard time signal, a time display means 3 for displaying time based on a reference signal, a generating means 4 for producing power by converting external energy to electrical energy, a motion detection means 5 for detecting if the radio-controlled timepiece 1 is moving, a location detection means 6 for detecting the location (current location) of the radio-controlled timepiece 1, a control circuit (control means) 7 for controlling operation of the receiver 2 and time display means 3, and a power supply 8 for storing power generated by the generating means 4 (4A) and supplying power to the radio-controlled timepiece 1.

The receiver 2 receives a longwave standard time signal to which time information is superimposed, such as the JJY standard time signal broadcast in Japan, and outputs the received longwave standard time signal as a time signal. This receiver 2 has an antenna 21 and a reception circuit 22.

The antenna 21 is a ferrite antenna, for example, designed for receiving a longwave standard time signal carrying time information. A longwave standard time signal such as the JJY signal is transmitted in a predefined time code format transmitting one signal each second and one complete time code record every 60 seconds. The fields contained in this time code format include the minute and hour of the current time, the number of days since January first of the current year, the year (denoted by the last two digits of the Gregorian calendar year), the day of the week, and the leap seconds. The JJY time signal is transmitted at 40 kHz and 60 kHz in Japan with both signals carrying the same time code.

Although the specific configuration is not shown in the figures, the reception circuit 22 has an amplifier circuit for amplifying the longwave standard time signal received through the antenna 21, a bandpass filter for extracting only a desired frequency component from the amplified longwave standard time signal, a demodulation circuit for smoothing and demodulating the longwave standard time signal, an automatic gain control (AGC) circuit for controlling the gain of the amplifier circuit to hold the reception level of the longwave standard time signal constant, and a decoding circuit for decoding and outputting the demodulated longwave standard time signal.

The bandpass filter could have a filter for extracting 40-kHz signals and a parallel filter for extracting 60-kHz signals.

The reception circuit 22 could automatically select and receive the 40-kHz standard time signal or the 60-kHz standard time signal based on which signal can be received under the best reception conditions, but typically stores the previously received frequency and operates at that frequency.

The time display means 3 has a reference signal generator (not shown in the figure) for generating a reference signal, an analog display 31 having hands 311, and a timepiece drive unit 32 for driving the hands 311 based on the reference signal from the reference signal generator to display the time.

The reference signal generator has an oscillation circuit with a reference oscillation source such as a quartz oscillator or ceramic oscillator, and a frequency divider for frequency dividing the reference oscillation signal to generate the reference signal.

The display 31 has hands 311 including hour, minute, and second hands, and a dial 312, and displays the time by moving the hands 311 around a single point on the dial 312.

The timepiece drive unit 32 drives the hands 311 based on a signal output from the control circuit 7 to display the time. The timepiece drive unit 32 has a stepping motor and a motor drive circuit for applying drive pulses to the stepping motor.

The stepping motor has a rotor connected through a gear train to the hands 311, a stator rotatably supporting the rotor, and a drive coil connected to the stator. When a drive pulse is applied from the motor drive circuit to the drive coil, the rotor turns. The rotary movement of the rotor is transmitted through the gear train to the hands 311, thus causing the hands 311 to move circularly and advance in steps. The hands 311 thus point to specific positions on the dial 312 and thereby indicate the time. A signal synchronized to the drive pulse is also output to the control circuit 7, and the control circuit 7 thus confirms the time indicated by the hands 311.

The generating means 4 (4A) is a photoelectric generating means that produces power when a solar cell is exposed to sunlight or artificial light as the external energy source. The solar cell could be a silicon solar cell made from single-crystal silicon, polycrystalline silicon, or amorphous silicon, or a compound semiconductor solar cell.

The location detection means 6 detects the location of the radio-controlled timepiece 1 by monitoring power generation by the generating means 4 (4A), and determines if the radio-controlled timepiece 1 is located where the standard time signal can currently be received. If sufficient output voltage from the generating means 4 (4A) is assured, the generating means 4 (4A) is exposed to sufficient light, which typically means that the radio-controlled timepiece 1 is outside a building or is inside a building but near a window.

More specifically, the likelihood is high that nothing is obstructing reception of the standard time signal and the signal can therefore be received. The location detection means 6 therefore determines that the radio-controlled timepiece 1 is located in a place where the standard time signal can be received if the output voltage from the generating means 4 (4A) is greater than or equal to a specified level, and thus outputs a receivable_location detection signal as the current location detection signal to the control circuit 7 from an output unit not shown. If this is not the case, that is, if the output voltage of the generating means 4 (4A) is less than the specified level, the location detection means 6 determines that the radio-controlled timepiece 1 is inside a building, underground such as in a subway, or is otherwise located where the standard time signal cannot be received, and the output unit of the location detection means 6 therefore outputs an out_of_reception_range detection signal as the current location detection signal to the control circuit 7.

The output voltage Va used as the threshold value for current location detection by the location detection means 6 is set appropriately with consideration for the typical usage conditions of the radio-controlled timepiece 1. More specifically, the conditions used by the location detection means 6 to determine the current location (the "location determination conditions" below) are set differently during the day and during the night because the ambient luminance from sunlight differs greatly between day and night. When the radio-controlled timepiece 1 receives the standard time signal during the day there are many factors that can interfere with the standard time signal, and receiving the standard time signal is difficult if the timepiece is inside a building and not near a window. This ambient luminance level is therefore set to 7000 lux, which is the typical ambient luminance at a particular critical distance from the window at which the standard time signal can be successfully received during the day.

Figure 3:
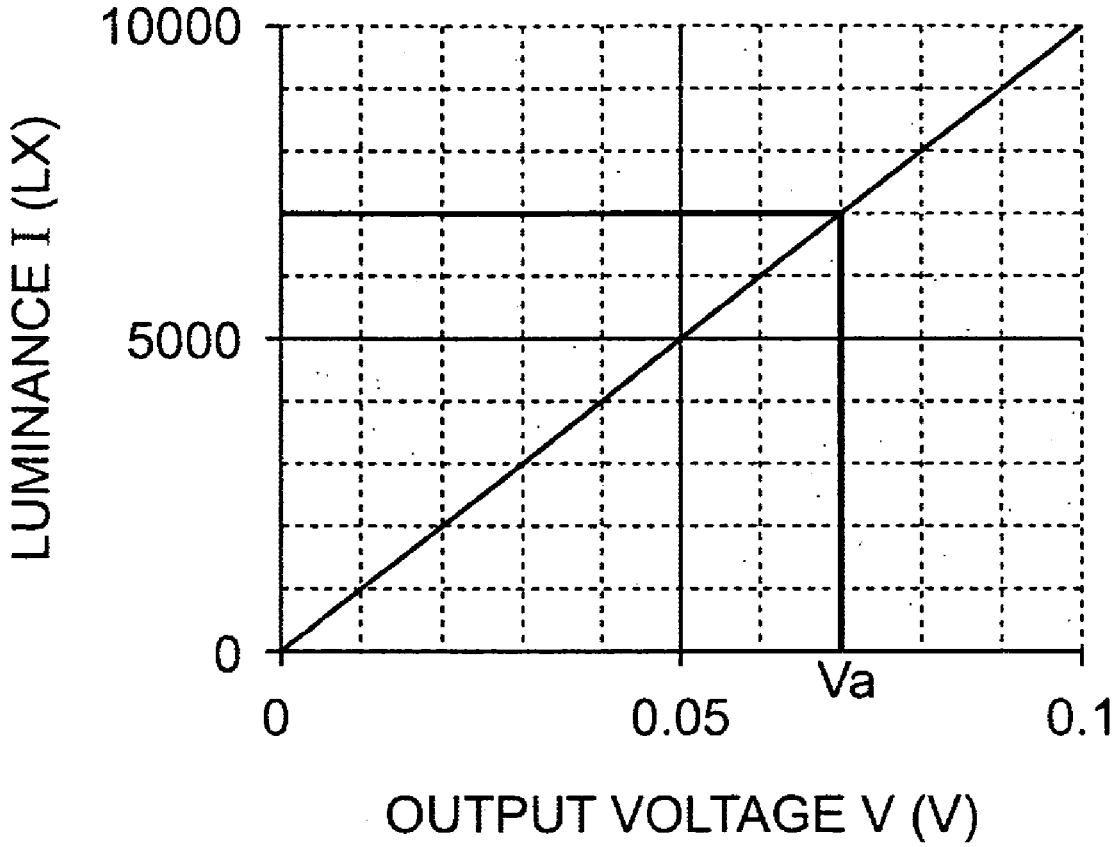
FIG. 3 describes the relationship between the ambient luminance level and the voltage generated by the power generating means.

FIG. 3 shows the relationship between the luminance level of light on the generating means 4 (4A) and the output voltage of the generating means 4 (4A). As shown in FIG. 3, luminance I and output voltage V are directly proportional, and the output voltage V of the generating means 4 (4A) is 0.07 V when luminance I is 7000 lux. The output voltage Va used to determine the location by the location detection means 6 during the day is set to 0.07 V in this embodiment of the invention.

The threshold value used by the location detection means 6 can also be determined by acquiring the output voltage V at the required luminance I from the relationship between the luminance I and output voltage V even if this relationship is not linearly proportional as shown in FIG. 3 but is defined by a quadratic function or logarithmic function, for example. The threshold value used by the location detection means 6 to determine the location shall thus not be limited to a directly proportional relationship between the luminance and output voltage, but can be determined according to a desired relationship between the luminance and output voltage.

The standard time signal can also be received at night even if not near a window due to the effect of the ionosphere. An output voltage threshold value Va is therefore not defined and the location detection means 6 is not used to determine whether the standard time signal can be received or not at night.

More specifically, the location detection means 6 also has a day/night determination means for determining whether the current time is during the day or during the night, and this day/night determination means determines whether it is day or night based on the current time information from the control circuit 7. The day/night determination means in this embodiment of the invention is set to determine that "day" is from 7:00 a.m. to 5:00 p.m., and "night" is from 5:00 p.m. to 7:00 a.m.

The location detection means 6 thus also functions as a threshold value setting means for setting the threshold value used to determine the location based on the result from the day/night determination means.

The motion detection means 5 has a power generation detection circuit 51 (power generation detection means) for detecting how much power is output by the generating means 4 (4A), and a decision unit 52 for determining whether the radio-controlled timepiece 1 is moving or not moving from the output power information from the power generation detection circuit 51.

The power generation detection circuit 51 detects the voltage of the power output by the generating means 4 (4A), and passes the detected voltage level to the decision unit 52. The power generation detection circuit 51 is, for example, a comparator circuit having one input terminal connected to a reference voltage and another input terminal connected to the output terminal of the generating means 4 (4A).

Instead of a comparator circuit, the power generation detection circuit 51 could alternatively be an inverter that inverts the output when a particular threshold value is exceeded. More specifically, the power generation detection circuit 51 can be any circuit arrangement that can detect the voltage or current output of the generating means 4 (4A).

The decision unit 52 monitors the output voltage from the power generation detection circuit 51, and based on this voltage determines if the radio-controlled timepiece 1 is moving.

Figure 4:
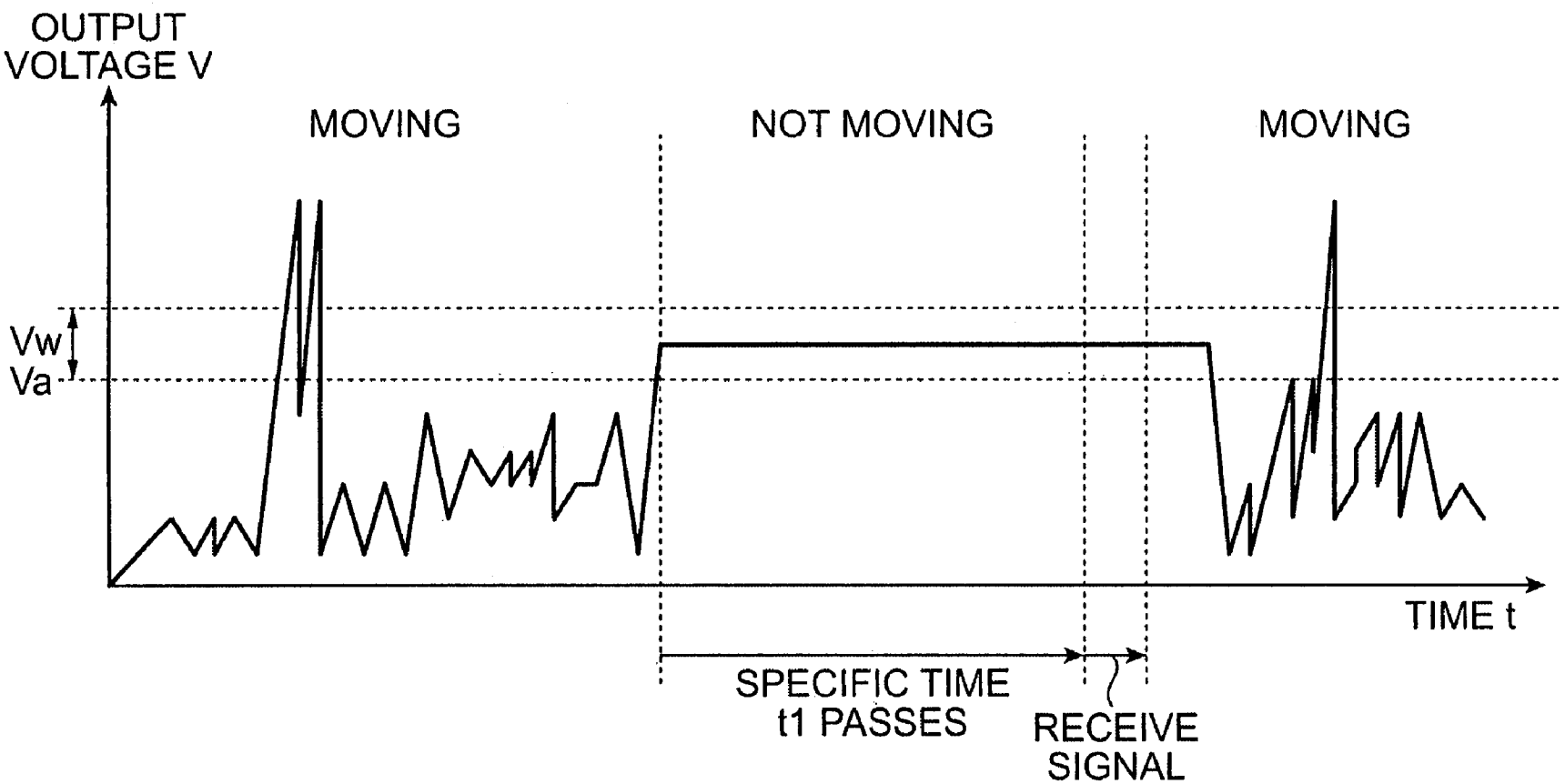
FIG. 4 shows the variation in output voltage over time by the power generating means in the first embodiment of the invention.

FIG. 4 shows the change in the output voltage V of the generating means 4 (4A) over time t. As shown in FIG. 4, output voltage V varies when the radio-controlled timepiece 1 is moving, such as when it is worn by the user, because the light received by the solar cell of the generating means 4 (4A) varies when the timepiece is moving. However, when the radio-controlled timepiece 1 is not worn and is thus not moving, the solar cell is exposed to a substantially constant light level, and the output voltage V is therefore also substantially constant.

The decision unit 52 uses this characteristic to determine if the timepiece is moving. More specifically, if the average variation Vwa in the output voltage V during a specific time t1 is within a specified range, the decision unit 52 determines that the timepiece is not being worn and is not moving. Otherwise, that is, if an output voltage V outside this specified range is input intermittently or continuously during time t1, the decision unit 52 determines that the radio-controlled timepiece 1 is being worn and is moving.

The actual output voltage V can be detected continuously throughout time t1, but the output voltage V is preferably sampled at a specific interval, such as at a specific interval from 1 second to 60 seconds, in order to reduce power consumption.

The specified time t1 used for determining if the timepiece is moving, and the range (constant range) Vw of the variation in the output voltage V used as the threshold value for determining if the timepiece is moving, can be set appropriately with consideration for the conditions in which the radio-controlled timepiece 1 is used. The time t1 for monitoring the output voltage V is set to 10 minutes in this embodiment of the invention based on the assumption that the timepiece is in a "not moving" (i.e., stationary) condition when the radio-controlled timepiece 1 is not being worn and is resting on a table, for example, so that the timepiece will not be determined to be stationary when the user has simply paused and the timepiece is only momentarily not moving.

Similarly to the threshold values used by the location detection means 6, the variation Vw in the power output of the generating means 4 (4A) is also set separately for day and night because the brightness of the sun differs greatly between day and night.

Figure 5:
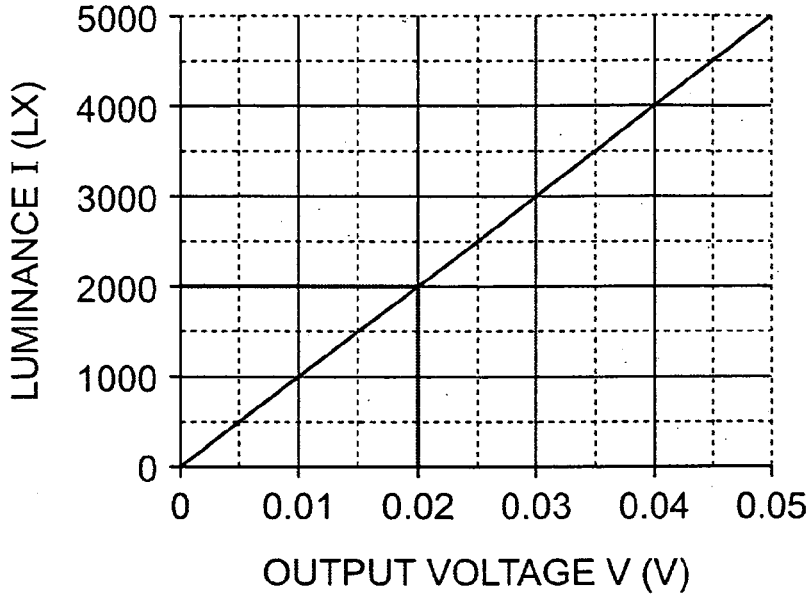
FIG. 5 shows the relationship between the ambient luminance level and the voltage generated by the power generating means.
Figure 6:
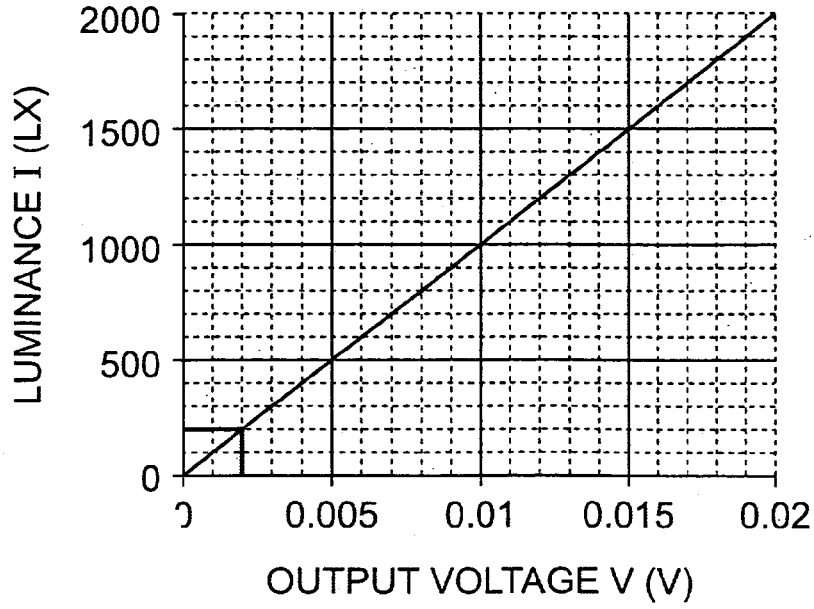
FIG. 6 shows another example of the relationship between the ambient luminance level and the voltage generated by the power generating means.

FIG. 5 and FIG. 6 show the relationship between the luminance I and output voltage V of the generating means 4 (4A).

During the day when the radio-controlled timepiece 1 is not being worn and is resting on some surface, the change in power output, that is, the ambient luminance to which the solar cell is exposed, is primarily due to changes in the weather whether inside beside a window or outdoors. Considering these changes in luminance due to changes in the weather, the luminance change during the daytime is set to 2000 lux/minute. From the proportional relationship between luminance I and output voltage V shown in FIG. 5, the output voltage V is known to change from 0.02 V to 0.04 V when the luminance I changes from 2000 lux to 4000 lux, and a 2000 lux change in luminance I corresponds to a 0.02 V change in the output voltage V. That is, if the luminance I changes 2000 lux, the output voltage V changes 0.02 V. The variation Vw1 in the output voltage during the day is therefore set to 0.02 V/minute in this embodiment of the invention. In addition, the change in the output voltage is calculated from the sampling data detected over one minute, that is, the change in the output voltage is calculated at one minute intervals, in this embodiment of the invention.

At night when the radio-controlled timepiece 1 is not being worn and is resting on some surface, the change in power output is primarily due to a person walking by the timepiece and blocking light from the indoor lighting. Considering the change in luminance I due to such factors, the change in luminance at night is set to 200 lux/minute. From FIG. 6 we know that the output voltage V changes 0.002 V when the luminance I changes 200 lux, and the variation Vw2 in the output voltage at night is therefore set to 0.002 V/minute.

As with setting the threshold values used by the location detection means 6 [5, sic], the threshold values of the motion detection means 5 can be set by acquiring the output voltage V for a required luminance I from the relationship between the luminance I and output voltage V even if the relationship between the luminance I and output voltage V is not directly proportional as shown in FIG. 5 and FIG. 6, but instead is expressed as a quadratic function or a logarithmic function.

Using the foregoing settings during the day, the motion detection means 5 determines that the radio-controlled timepiece 1 is not moving and outputs a not_moving detection signal from an output unit not shown to the control circuit 7 if the average variation Vwa during a specified time t1 (10 minutes) in the variation of the output voltage V from the generating means 4 (4A) is within a first specified range Vw1 (0.02 V/minut). The motion detection means 5 otherwise outputs a motion detection signal indicating that the timepiece is moving.

At night, the motion detection means 5 determines that the radio-controlled timepiece 1 is not moving and outputs a not_moving detection signal from an output unit not shown to the control circuit 7 if the average variation Vwa during a specified time t1 (10 minutes) in the variation of the output voltage V from the generating means 4 (4A) is within a second specified range Vw2 (0.002 V/minute). The motion detection means 5 otherwise outputs a motion detection signal indicating that the timepiece is moving.

The control circuit 7 is substantially identical to the control circuit in a typical radio-controlled timepiece and is therefore not shown in detail in the figures, but has a time counter, a time counter control circuit, a hand position counter, and a reception schedule control unit. The control circuit 7 also has a reception operation control means not shown for controlling the reception operation of the receiver 2 based on the location detection signal from the location detection means 6. More specifically, the control circuit 7 has a reception driving means for driving the reception operation of the receiver 2 when the receivable_location detection signal is output from the location detection means 6 and the not_moving detection signal is output from the motion detection means 5, and a reception blocking means that blocks the reception operation of the receiver 2 when the out_of_reception_range detection signal is output from the location detection means 6 and the motion detection signal is output from the motion detection means 5.

The time counter is connected to the reference signal generator, and thus counts the reference signal output from the reference signal generator and keeps the current time. The time counter also outputs a signal corresponding to the kept time to the motor drive circuit of the timepiece drive unit 32, and the motor drive circuit outputs drive pulses using this time signal.

The time counter control circuit determines if the time information received by the reception circuit 22 is correct when the reception circuit 22 receives the standard time signal, and adjusts the current time kept by the time counter based on whether the received time information is correct and the decoded time information. Whether or not the received time information is correct can be determined using a longwave standard time signal, for example, by receiving multiple frames (usually two or three frames) of the time information transmitted at one minute intervals and detecting if the received time information indicates a specified time difference. For example, if two or more consecutive frames are received and the time indicated by the time information received in the consecutive frames is at one minute intervals, the received time information is known to be correct.

A signal synchronized to the drive pulse output by the motor drive circuit is input to the hand position counter, and based on this signal the hand position counter counts up each time the hands 311 are advanced by the drive pulse. The value stored by the hand position counter thus changes as the hands 311 move, and the value of the hand position counter corresponds to the positions of the hands 311.

The reception schedule control unit causes the receiver 2 to receive the standard time signal at a specified period. In this embodiment of the invention the receiver 2 is scheduled to receive the standard time signal daily at 2:00 a.m., and the motion detection means 5 is set to detect the current location of the radio-controlled timepiece 1 and determine if the timepiece is moving before the time t1 at which the reception operation of the receiver 2 begins. The reception schedule control unit is therefore set to output the time adjustment operation start command 10 minutes before 2:00 a.m., that is, at 1:50 a.m. The motion detection means 5 and location detection means 6 therefore also have the function of a reception operation linking means to operate in conjunction with the reception operation of the receiver 2. If receiving the standard time signal fails, the reception schedule control unit resets the reception schedule to two hours later.

To control operation of the timepiece drive unit 32, the control circuit 7 compares the count stored by the time counter and the count stored by the hand position counter when the time information is received by the receiver 2 and the value of the time counter is adjusted by the time counter control circuit. If the compared counter values do not match, an appropriate signal is output to the timepiece drive unit 32 to correct the time indicated by the hands 311.

The power supply 8 has a first storage cell 81 such as a small capacity capacitor, a second storage cell 82 such as a high capacity capacitor, a switch 83 for switching the second storage cell 82 connection on and off, a limit switch 84 for shorting the generating means 4 (4A), and a charging control circuit 85 for controlling operation of switch 83 and limit switch 84.

The charging control circuit 85 is a comparator, an inverter, or a circuit combining a comparator and an inverter with one input terminal connected to a reference voltage and the other input terminal connected to the output terminal of the second storage cell 82 for monitoring the power stored in the second storage cell 82. The charging control circuit 85 shall not be so limited, however, and can be any circuit arrangement capable of detecting the power stored in the second storage cell 82.

If sufficient power is not stored in the second storage cell 82 when the radio-controlled timepiece 1 starts, the charging control circuit 85 turns switch 83 off and thus disconnects the second storage cell 82 so that only the first storage cell 81 is charged. The radio-controlled timepiece 1 is then driven by the power stored in the first storage cell 81. When sufficient voltage is assured for radio-controlled timepiece 1 operation, the charging control circuit 85 turns switch 83 on to connect and charge the second storage cell 82. The charging control circuit 85 monitors the voltage of the second storage cell 82, and turns the limit switch 84 on when the accumulated voltage reaches a set voltage level. This shorts the generating means 4 (4A) so that the second storage cell 82 is not charged further.

This control method assures good starting performance because the low capacity first storage cell 81 can be charged quickly when the radio-controlled timepiece 1 turns on.

Operation of a radio-controlled timepiece 1 thus comprised is described next below.

When the radio-controlled timepiece 1 is driven to simply display the time, the control circuit 7 compares the current time indicated by the time counter with the time indicated by the hands 311 and monitored by the hand position counter, and based on the result drives the stepping motor by way of the timepiece drive unit 32. Rotation of the rotor when the stepping motor is driven is transferred through a gear train to the hands 311, thus causing the hands 311 to move over the dial 312 and display the current time.

The time adjustment operation of this radio-controlled timepiece 1 is described next below.

Figure 7:
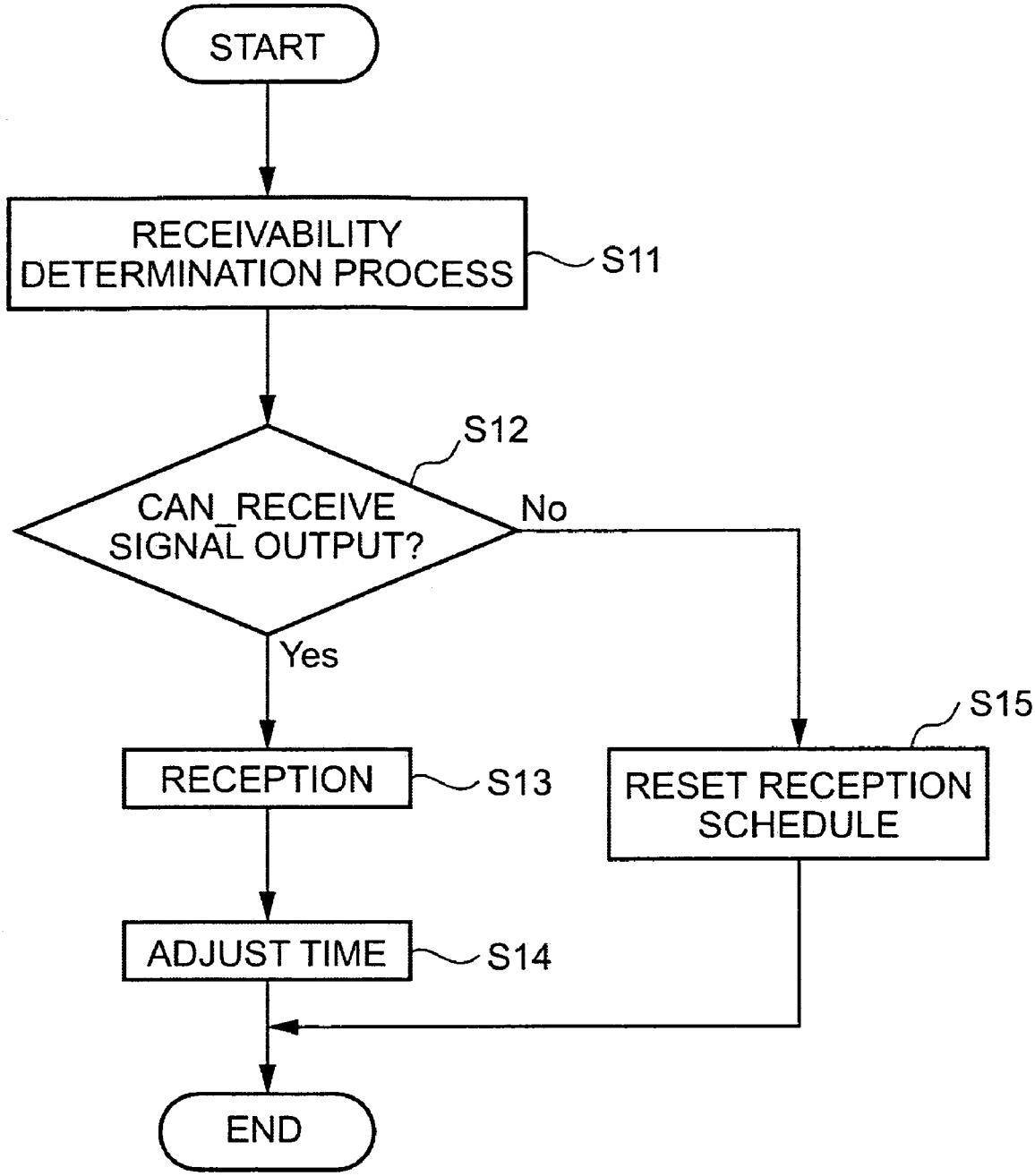
FIG. 7 is a flow chart describing the operation of the radio-controlled timepiece in the first embodiment of the invention.

FIG. 7 is a flow chart of the operation of a radio-controlled timepiece 1 according to this first embodiment of the invention.

The reception schedule control unit of the control circuit 7 outputs a standard time signal reception command at 1:50 a.m., the time at which the time adjustment operation of the radio-controlled timepiece 1 starts. Based on this command, the control circuit 7 causes the location detection means 6 and motion detection means 5 to run a receivability determination process in step S11 to determine whether the standard time signal can be received by the receiver 2 under the current conditions.

Figure 8:
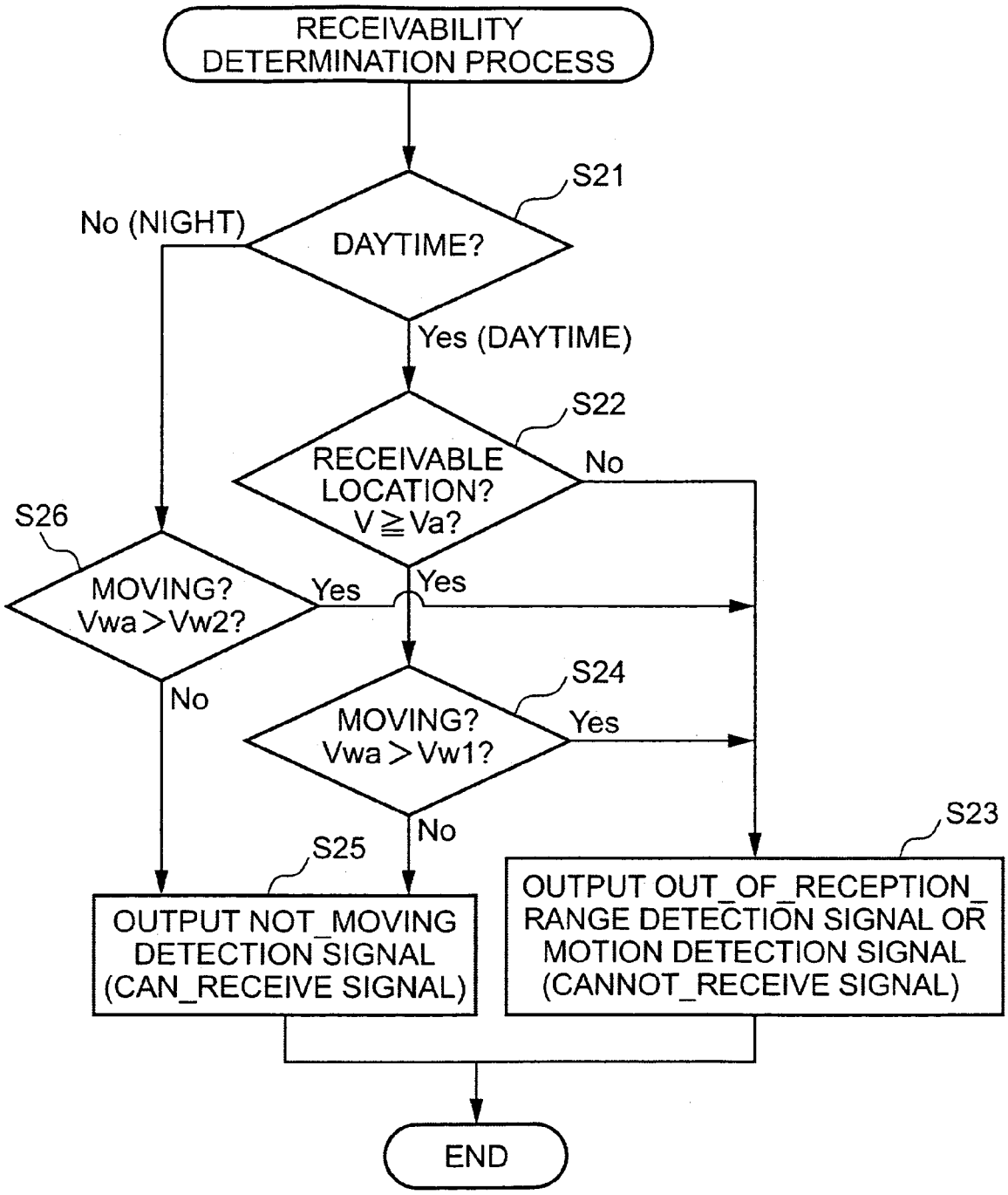
FIG. 8 is a flow chart describing the operation of the radio-controlled timepiece in the first embodiment of the invention.

FIG. 8 is a flow chart of this receivability determination process.

As shown in FIG. 8, the first step in this process is for the location detection means 6 to determine based on the current time information input from the control circuit 7 whether it is currently daytime or nighttime based on the current time (step S21) (the day/night determination step). If the current time is between 7:00 a.m. and 5:00 p.m., it is daytime (step S21 returns yes). Whether the radio-controlled timepiece 1 is resting or worn where the standard time signal can be received, such as beside a window, is then determined (step S22) (location detection step).

As described above, if the power output (output voltage) V from the generating means 4 (4A) is greater than or equal to a specified output voltage Va (greater than or equal to 0.07 V in this embodiment), the location detection means 6 determines that the radio-controlled timepiece 1 is located where the standard time signal can be received, and outputs the receivable_location detection signal to the control circuit 7. If the output voltage V is less than or equal to output voltage Va (step S22 returns no), the location detection means 6 determines that the radio-controlled timepiece 1 is located where the standard time signal cannot be received, such as inside a building away from a window or underground in a subway, for example, and therefore outputs an out_of_reception_range detection signal (cannot_receive signal) to the control circuit 7 in step S23 (receivability signal output step).

If the location detection means 6 determines that the radio-controlled timepiece 1 can receive the standard time signal (step S22 returns yes), the motion detection means 5 determines whether the radio-controlled timepiece 1 is being worn and moving or is stationary (step S24) (moving/not-moving detection step).

As described above, the power generation detection circuit 51 of the motion detection means 5 monitors the power output (output voltage V) of the generating means 4 (4A) for 10 minutes. If the average variation Vwa in the output voltage V during this 10 minute period is within a specified range Vw1 (0.02 V/minute in this embodiment), the motion detection means 5 determines that the radio-controlled timepiece 1 is not moving (step S24 returns no) and outputs a not_moving detection signal (can_receive signal) to the control circuit 7 in step S25 (receivability signal output step).

If the average variation Vwa in the output voltage V is greater the variation Vw1 (step S24 returns yes), the decision unit 52 determines that the radio-controlled timepiece 1 is being worn and is unable to receive the standard time signal, and therefore outputs the motion detection signal (cannot_receive signal) to the control circuit 7 in step S23 (receivability signal output step).

If the location detection means 6 determines that the current time is during the night, that is, between 5:00 p.m. and 7:00 a.m. (step S21 returns no), the motion detection means 5 immediately determines whether the radio-controlled timepiece 1 is being worn or not in step S26 (moving/not-moving detection step) without the location detection means 6 detecting whether the output voltage is greater than or equal to output voltage Va in step S22. If the average variation Vwa in the output voltage V during the 10 minute monitoring period is within the defined range Vw1 (is less than or equal to 0.002 V/minute in this embodiment) (step S26 returns no), the motion detection means 5 determines that the radio-controlled timepiece 1 is not being worn and that the standard time signal can be received, and therefore outputs the not_moving detection signal (can_receive signal) to the control circuit 7 in step S25 (receivability signal output step).

If the average variation Vwa in the output voltage V is greater than range Vw2 (step S26 returns yes), the decision unit 52 determines that the radio-controlled timepiece 1 is being worn and the standard time signal cannot be received, and therefore outputs the motion detection signal (cannot_receive signal) to the control circuit 7 in step S23 (receivability signal output step).

Returning to FIG. 7, the control circuit 7 determines whether the can_receive signal was output (step S12) from the receivability determination process run by the radio-controlled timepiece 1 in step S11 as described in FIG. 8. If the out_of_reception_range detection signal or motion detection signal was output, that is, if the cannot_receive signal was output (step S12 returns no), the likelihood is high that reception will fail if receiving the standard time signal is attempted. The reception blocking means of the control circuit 7 therefore prevents the receiver 2 from receiving the standard time signal (no_reception step). The reception schedule control unit of the control circuit 7 then sets the signal reception schedule to two hours later (step S15), and the time adjustment control process ends.

If the not_moving detection signal was output from the receivability determination process run by the radio-controlled timepiece 1 in step S11 (see FIG. 8), that is, the can_receive signal was output (step S12 returns yes), the reception driving means of the control circuit 7 drives the receiver 2 to receive the standard time signal through the antenna 21 (step S13, reception step).

Based on the time information decoded from the standard time signal, the control circuit 7 then compares the value stored by the time counter and the value stored by the hand position counter, and outputs an appropriate signal to the timepiece drive unit 32 to adjust the hands according to the difference between the counters. The timepiece drive unit 32 then drives the hands 311 by means of the stepping motor and gear train as described above to adjust the hands to display the correct time (time adjustment step).

The foregoing embodiment of the present invention affords the following benefits.

(1) The location detection means 6 can determine whether the radio-controlled timepiece 1 is located inside near a window, outside, or some other place where the standard time signal can be received. The likelihood that reception will succeed when attempted can therefore be improved, and the standard time signal can thus be received more dependably and reliably when reception is attempted. Reception operations that are likely to fail can thus be prevented, and power consumption by the radio-controlled timepiece 1 can be reduced.

Furthermore, because the location detection means 6 determines the current location of the radio-controlled timepiece 1 based on how much power is generated by the generating means 4 (4A), which is a photoelectric generating means in this embodiment, the location can be determined easily and reliably. The arrangement of the location detection means 6 can also be simplified because information relating to power generation by the generating means 4 (4A) is used for the location determination.

(2) The location detection means 6 has a day/night determination means and can therefore also differentiate night and day based on the time information from the control circuit 7. In addition, the motion detection means 5 uses the photoelectric generating means in this embodiment, and the variation in power output by the generating means 4 (4A) differs between day and night. However, by setting and using different threshold values to detect whether the timepiece is moving or stationary during the day and during the night based on the variation Vw in the output voltage V from the generating means 4 (4A), the motion detection means 5 can more accurately detect if the radio-controlled timepiece 1 is moving or stationary.

Furthermore, because the location detection means 6 has a day/night determination means, the location detection means 6 also uses separate threshold values to detect the location of the radio-controlled timepiece 1 during the day and during the night. More specifically, if the day/night determination means determines that the current time is during daylight hours, the threshold value for detection by the location detection means 6 can be set to determine if the power output (generated voltage) V from the generating means 4A is greater than or equal to specified voltage Va. However, if the day/night determination means determines that the current time is during the night, a threshold value is not set for detection by the location detection means 6 and the location detection means 6 can be set to not detect the location. Because the threshold value used for the current location detection can thus be changed and set dynamically based on the day/night determination of the day/night determination means, the current location can be detected using parameters dynamically set to the actual conditions. The detection performance of the location detection means can thus be improved.

(3) Before receiving the standard time signal, the motion detection means 5 determines if the radio-controlled timepiece 1 is being worn, that is, is moving, and the standard time signal is received if the receivable_location detection signal is output from the location detection means 6 and the radio-controlled timepiece 1 is not being worn, that is, is not moving. The standard time signal can thus be received more reliably because the orientation of the antenna 21 is prevented from changing due to movement of the radio-controlled timepiece 1 during reception. The reliability of standard time signal reception by the radio-controlled timepiece 1 can thus be further improved.

Furthermore, because reception is not attempted when the likelihood that the standard time signal can be successfully received is low, wasteful reception operations can be prevented and power consumption from the power supply 8 due to attempted standard time signal reception can be reduced.

(4) By detecting if the radio-controlled timepiece 1 is moving or stationary based on information about power generation by the generating means 4 (4A), which produces power for driving the radio-controlled timepiece 1, the arrangement of the motion detection means 5 can be simplified. The manufacturing cost of the radio-controlled timepiece 1 can therefore also be reduced. Furthermore, because the location detection means 6 also uses information about power output by the generating means 4 (4A) to detect the current location of the radio-controlled timepiece 1, the arrangement of the location detection means 6 can also be simplified and the arrangement of the radio-controlled timepiece 1 can be yet further simplified.

Furthermore, because the motion detection means 5 operates before the specified time t1 at which the reception operation is scheduled to run, whether the radio-controlled timepiece 1 is moving or stationary is detected in conjunction with the reception operation of the receiver 2. Whether reception is possible or not can therefore be determined immediately before reception begins, thus affording more reliable signal reception.

(5) The motion detection means 5 is a photoelectric generating means that converts light energy to electrical energy. Electrical generation thus varies when the illumination changes as a result of radio-controlled timepiece 1 movement, and whether the radio-controlled timepiece 1 is moving or stationary can thus be easily and reliably determined by monitoring if the average variation in generator output is within a specified range during a specified period.

Furthermore, calculating the average change in power output provides a more reliable detection result because averaging eliminates temporary spikes (abnormal values) caused, for example, by a person's shadow blocking light and causing a large momentary change in power output when the radio-controlled timepiece 1 is not moving.

Second Embodiment

A second embodiment of the present invention is described next below. This second embodiment differs from the foregoing embodiment in that a different type of power generating means is used, and the external signal reception operation of the control means differs.

Figure 9:
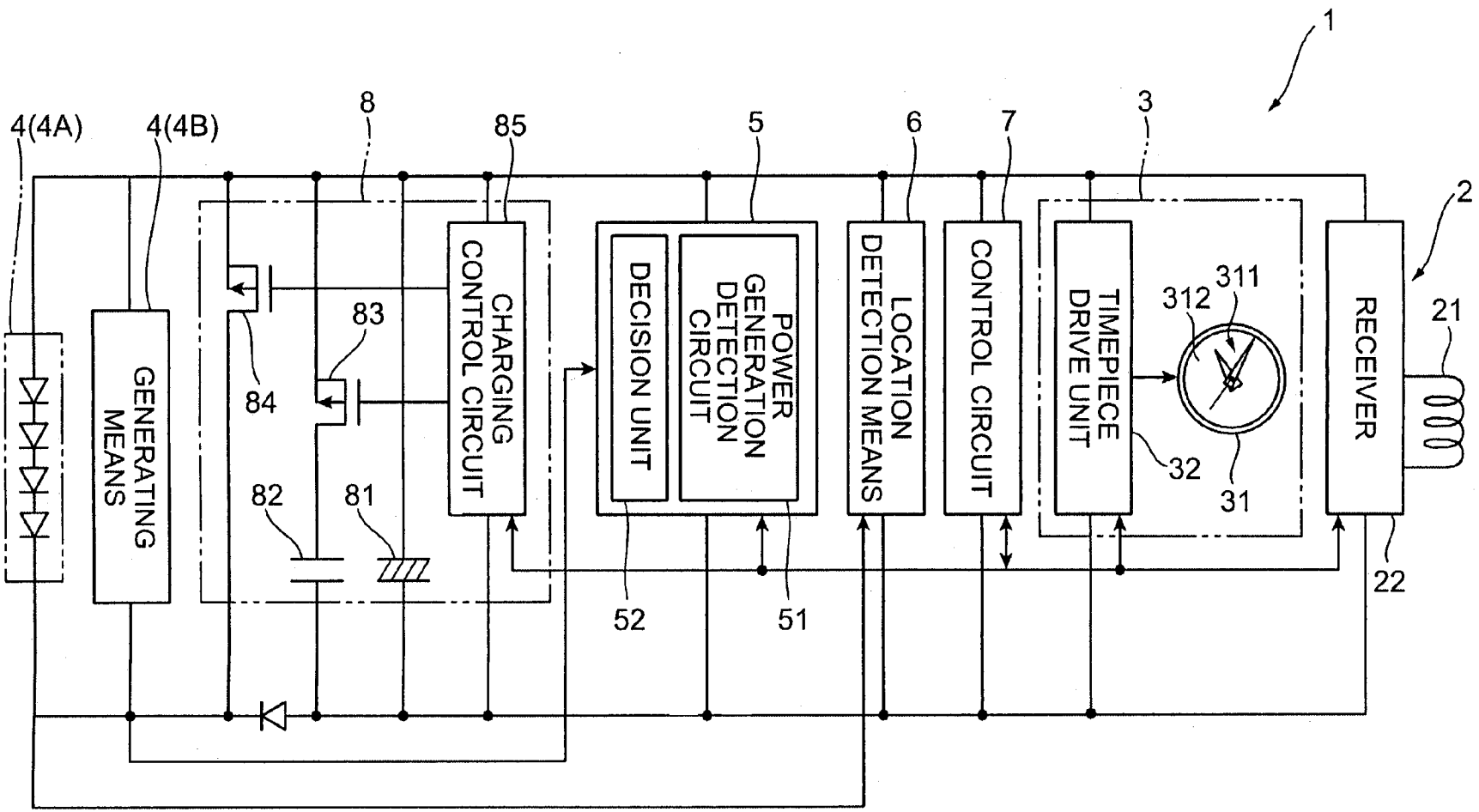
FIG. 9 is a function block diagram of a radio-controlled timepiece according to a second embodiment of the present invention.

FIG. 9 is a function block diagram of a radio-controlled timepiece 1 according to this second embodiment of the invention. In addition to a photoelectric generating means 4 (4A) as used in the first embodiment, the generating means 4 in this second embodiment also has a mechanical generating means 4 (4B) for converting external mechanical energy to electrical energy as shown in FIG. 9.

Figure 10:
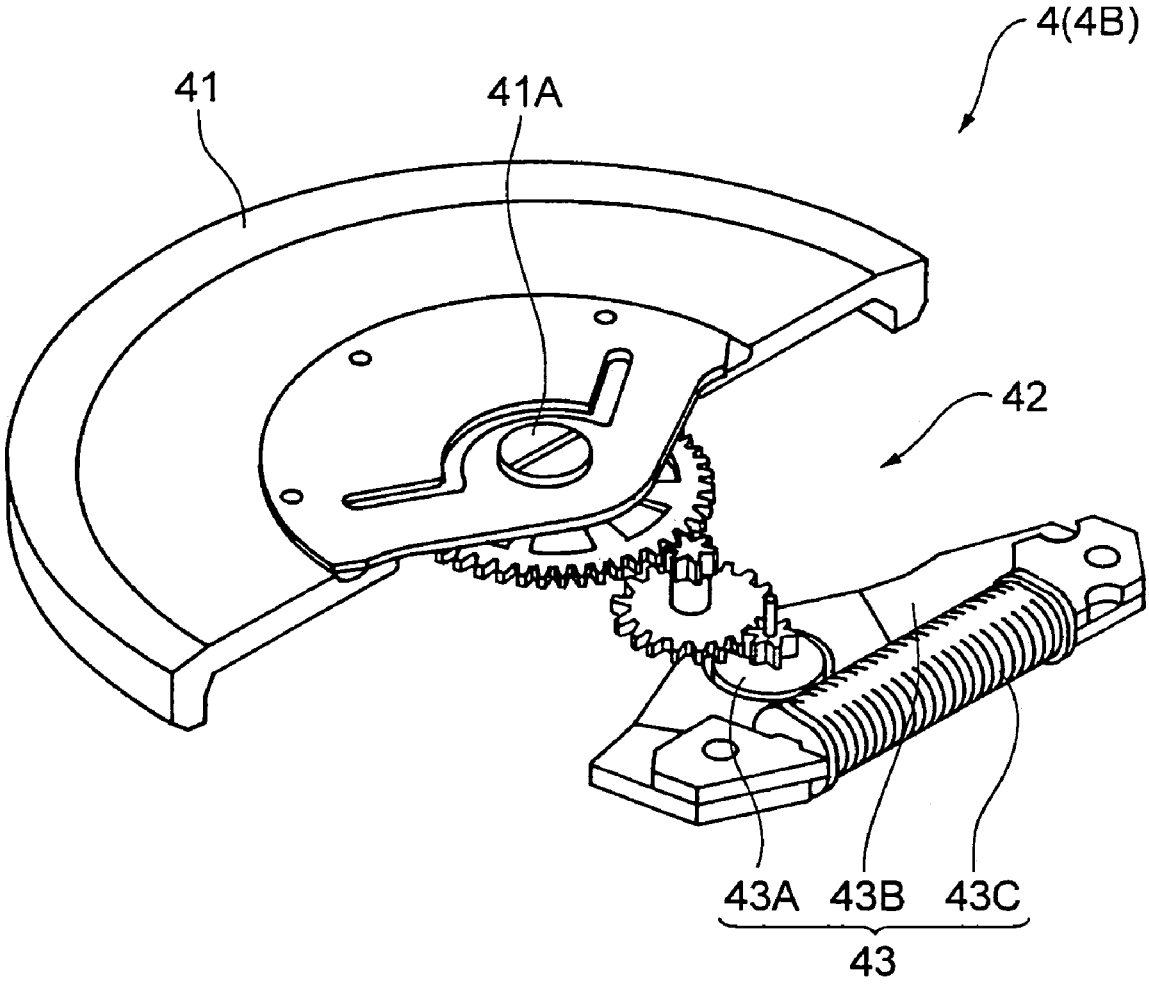
FIG. 10 is an oblique view of the power generating means in the second embodiment of the invention.

FIG. 10 is an oblique view of this mechanical generating means 4 (4B). As shown in FIG. 10, this mechanical generating means 4 (4B) has a rotary pendulum 41, a power transfer mechanism 42, and a generator 43.

The rotary pendulum 41 is connected to a rotating shaft 41A by an intervening ball bearing not shown. The center of gravity of the rotary pendulum 41 is eccentric to the axis of this rotating shaft 41A, and thus rotates freely when driven by external kinetic energy.

The power transfer mechanism 42 is a speed-increasing gear train composed of multiple gears that accelerate the rotation of the rotary pendulum 41 and transfer the rotary movement of the rotary pendulum 41 to the below-described rotor 43A of the generator 43.

The generator 43 is composed of a disc-shaped rotor 43A made from a two-pole permanent magnet, a stator 43B made of a high permeability material disposed surrounding this rotor 43A, and a generator coil 43C connected to this stator 43*b*.

When the radio-controlled timepiece 1 is worn on the user's wrist, for example, movement of the arm causes the rotary pendulum 41 of this mechanical generating means 4 (4B) to rotate. The power transfer mechanism 42 then accelerates and transfers this rotary motion to the rotor 43A of the generator 43, and rotation of the rotor 43A produces an alternating current in the coil 43C.

The power generation detection circuit 51 detects the output voltage V of the mechanical generating means 4 (4B) in the same way the output voltage V is detected in the first embodiment. More specifically, the power generation detection circuit 51 is a comparator having one input terminal connected to a reference voltage and the other input terminal connected to the output terminal of the mechanical generating means 4 (4B).

The decision unit 52 then determines if the radio-controlled timepiece 1 is worn and the timepiece is moving based on the power output (output voltage) from the power generation detection circuit 51.

Figure 11:
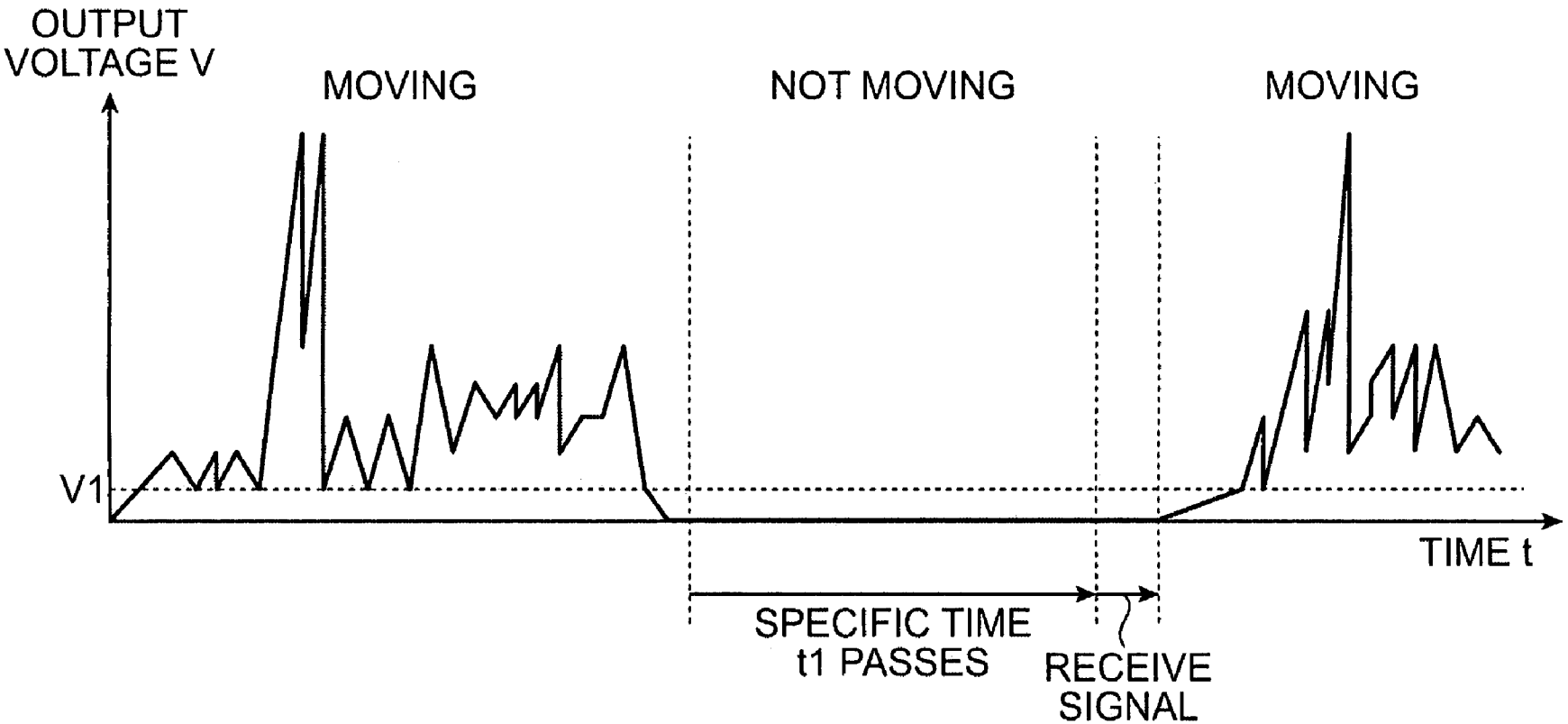
FIG. 11 shows the variation in output voltage over time by the power generating means in the second embodiment of the invention.

FIG. 11 shows the variation in the output voltage V of the generating means 4 (4B) over time t. As shown in FIG. 11, the radio-controlled timepiece 1 can be known to be moving when power is being generated because power is produced by rotation of the rotary pendulum 41 in conjunction with user movement when the radio-controlled timepiece 1 is worn.

If output voltage V is detected during the specified time t1, the decision unit 52 thus determines that the radio-controlled timepiece 1 is being worn and is moving, and outputs the motion detection signal to the control circuit 7. If the output voltage V is not detected during time t1, the decision unit 52 determines that the radio-controlled timepiece 1 is not being worn and outputs the not_moving detection signal to the control circuit 7.

In practice, the decision unit 52 determines that the radio-controlled timepiece 1 is being worn and is moving if the output voltage V during time t1 is greater than or equal to a specified threshold voltage V1 because slight vibrations will also produce a small amount of power even when the radio-controlled timepiece 1 is not being worn.

This specified threshold voltage VI is preferably set to 100 mV or less. However, because an electromagnetic brake is applied by the coil 43C when the rotary pendulum 41 is stopped in a typical generating means 4 (4B) having a rotary pendulum 41 and generator 43, small vibrations when the timepiece is not being worn effectively produce no power, and the specified threshold voltage V1 is therefore more preferably set to 0 V.

A location detection means 6 identical to the location detection means 6 in the first embodiment is also provided in this second embodiment. This location detection means 6 detects the current location of the radio-controlled timepiece 1 by monitoring power generation by the generating means 4 (4A) to determine if the radio-controlled timepiece 1 is currently located where the standard time signal can be received. The control circuit 7 also has a reception operation stopping means for stopping the reception operation of the receiver 2 if the control circuit 7 receives a motion detection signal from the motion detection means 5 while the receiver 2 is receiving the standard time signal.

Operation of this radio-controlled timepiece 1 is described next below.

Figure 12:
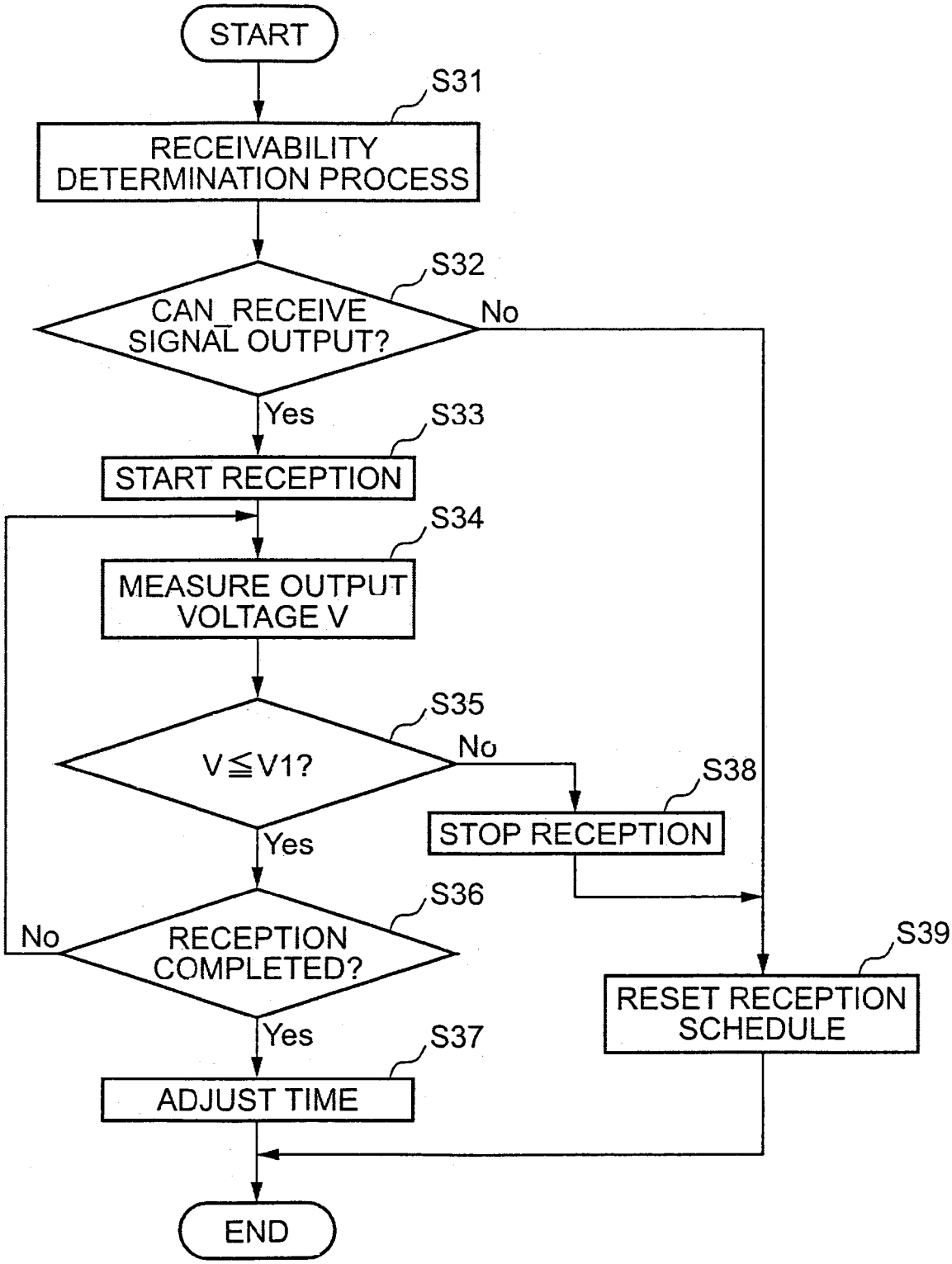
FIG. 12 is a flow chart describing the operation of the radio-controlled timepiece in the second embodiment of the invention.

FIG. 12 is a flow chart of the time adjustment operation of a radio-controlled timepiece 1 according to this second embodiment of the invention.

When the scheduled time adjustment time is reached and the reception schedule control unit of the control circuit 7 outputs time adjustment command, the control circuit 7 causes the location detection means 6 and motion detection means 5 to run a receivability determination process to determine whether the standard time signal can be received by the receiver 2 under the current conditions in step S31.

Figure 13:
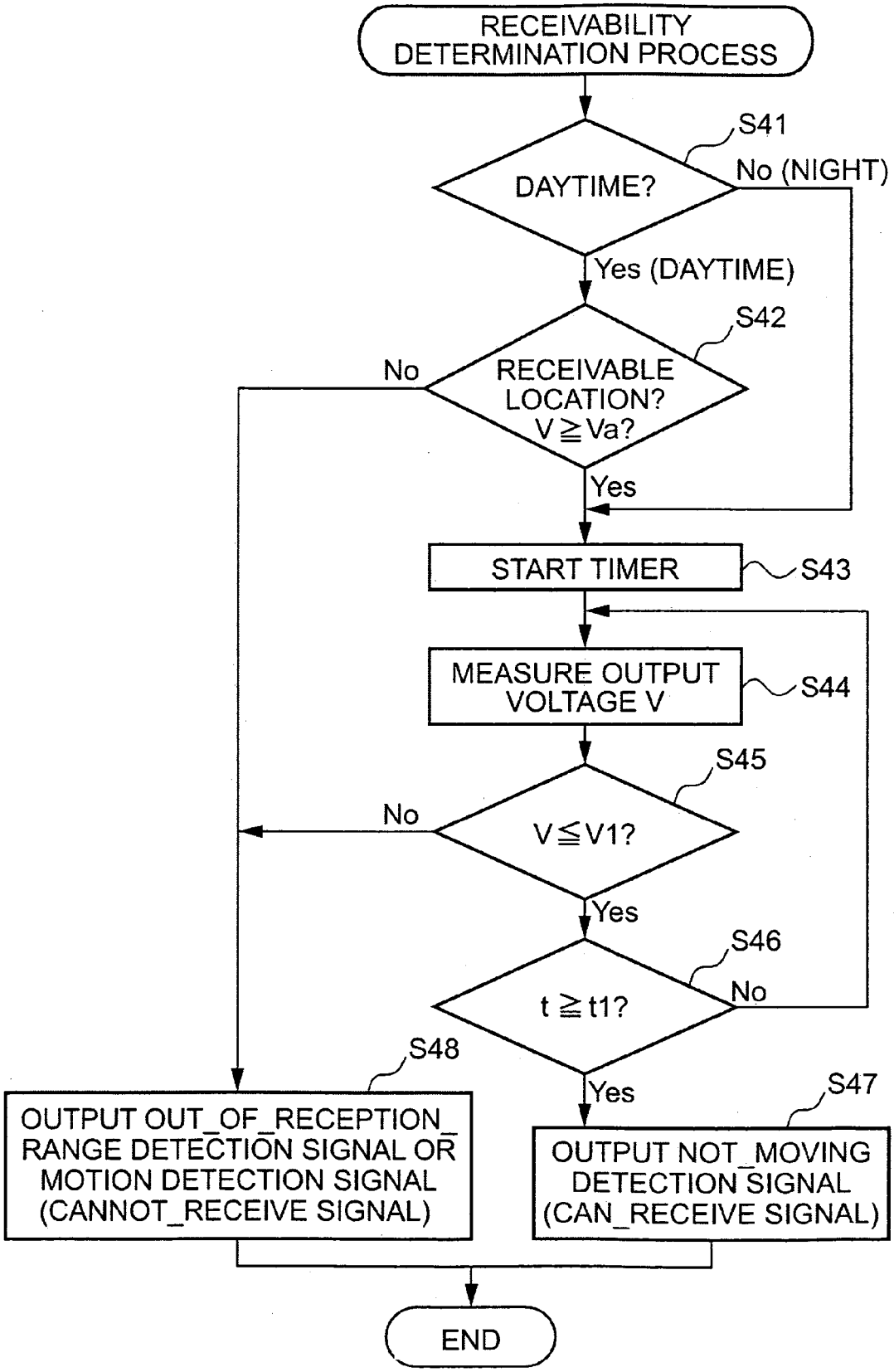
FIG. 13 is a flow chart describing the operation of the radio-controlled timepiece in the second embodiment of the invention.

FIG. 13 is a flow chart of this receivability determination process.

As shown in FIG. 13, the first step in this process is for the location detection means 6 to determine whether the current time is during the day or during the night (step S41) (the day/night determination step). This is done using the same method as in the first embodiment and described in FIG. 8. If it is daytime (step S41 returns yes), control goes to step S42. However, if the day/night determination means determines that it is currently night (step S41 returns no), the location detection means 6 does not detect the current location of the radio-controlled timepiece 1 and control skips to step S43.

In step S42 the location detection means 6 determines if the radio-controlled timepiece 1 is located where the standard time signal can be received using the same method as in the first embodiment (location detection step).

If the output voltage V from the generating means 4 (4A) is greater than or equal to output voltage Va (step S42 returns yes), the location detection means 6 determines that the radio-controlled timepiece 1 is located where the standard time signal can be received and outputs the receivable_location detection signal to the control circuit 7.

However, if the output voltage V from the generating means 4 (4A) is less than output voltage Va (step S42 returns no), the location detection means 6 determines that the radio-controlled timepiece 1 is not positioned where the standard time signal can be received. Control therefore goes to step S48 and the location detection means 6 outputs the out_of_reception_range detection signal (cannot_receive signal) to the control circuit 7.

If the location detection means 6 outputs the receivable_location detection signal in step S42 (step S42 returns yes), the motion detection means 5 determines if the radio-controlled timepiece 1 is being worn (step S43, moving/not-moving detection step).

The motion detection means 5 therefore starts an internal timer and begins to measure time t (step S43), and measures the output voltage V of the generating means 4 (4B) (step S44). In step S45 the motion detection means 5 determines if the output voltage V is less than or equal to specified threshold voltage V1, that is, less than or equal to 100 mV in this embodiment of the invention. If the output voltage V is less than or equal to specified threshold voltage VI (step S45 returns yes), the motion detection means 5 determines if the time t counted by the internal timer has reached the specified time t1, that is, 10 minutes in this embodiment (step S46). If time t is less than specified time t1 (step S46 returns no), the output voltage V has not been monitored for 10 minutes. Control therefore returns to step S44, and this loop repeats to measure the output voltage V again.

If the time t measured by the internal timer in step S46 reaches the specified time t1 (step S46 returns yes), detecting whether the timepiece is moving or stationary stops, and the motion detection means 5 outputs the not_moving detection signal (can_receive signal) to the control circuit 7 (step S47).

If in step S45 the output voltage V is greater than specified threshold voltage V1 (step S45 returns no), the decision unit 52 determines that the radio-controlled timepiece 1 is being worn, and outputs the motion detection signal (cannot_receive signal) to the control circuit 7 (step S48).

The motion detection means 5 thus monitors the output voltage V detected by the power generation detection circuit 51, and the decision unit 52 determines if the radio-controlled timepiece 1 is moving based on whether an output voltage V greater than or equal to specified threshold voltage V1 is detected in the 10 minute monitoring period.

Returning to FIG. 12 after the receivability determination process in step S31 is completed as described in FIG. 13, the control circuit 7 determines if the location detection means 6 output the out_of_reception_range detection signal or if the motion detection means 5 output the motion detection signal (step S32). More specifically, the control circuit 7 detects if the can_receive signal was output (step S32). If the out_of_reception_range detection signal or the motion detection signal was output, that is, if the cannot_receive signal was output (step S32 returns no), the control circuit 7 knows that there is a strong likelihood that receiving the standard time signal will fail. The reception blocking means of the control circuit 7 therefore prevents the signal reception operation (no_reception step). As in the first embodiment, the reception schedule is then reset, and the time adjustment operation ends.

However, if the not_moving detection signal was output, that is, the can_receive signal was output (step S32 returns yes), the receiver 2 receives the standard time signal in steps S33 to S36 (reception step).

The motion detection means 5 continues to detect the output voltage V from the generating means 4 (4B) in step S34 even after the receiver 2 starts receiving the standard time signal, and monitors if the output voltage V is less than or equal to the specified threshold voltage V1 (step S35). If the output voltage V is not greater than or equal to the specified threshold voltage V1 (step S35 returns yes), whether reception has ended is determined in step S36. If reception has not ended (step S36 returns no), control loops back to step S34, and standard time signal reception and output voltage V monitoring continue.

Figure 14:
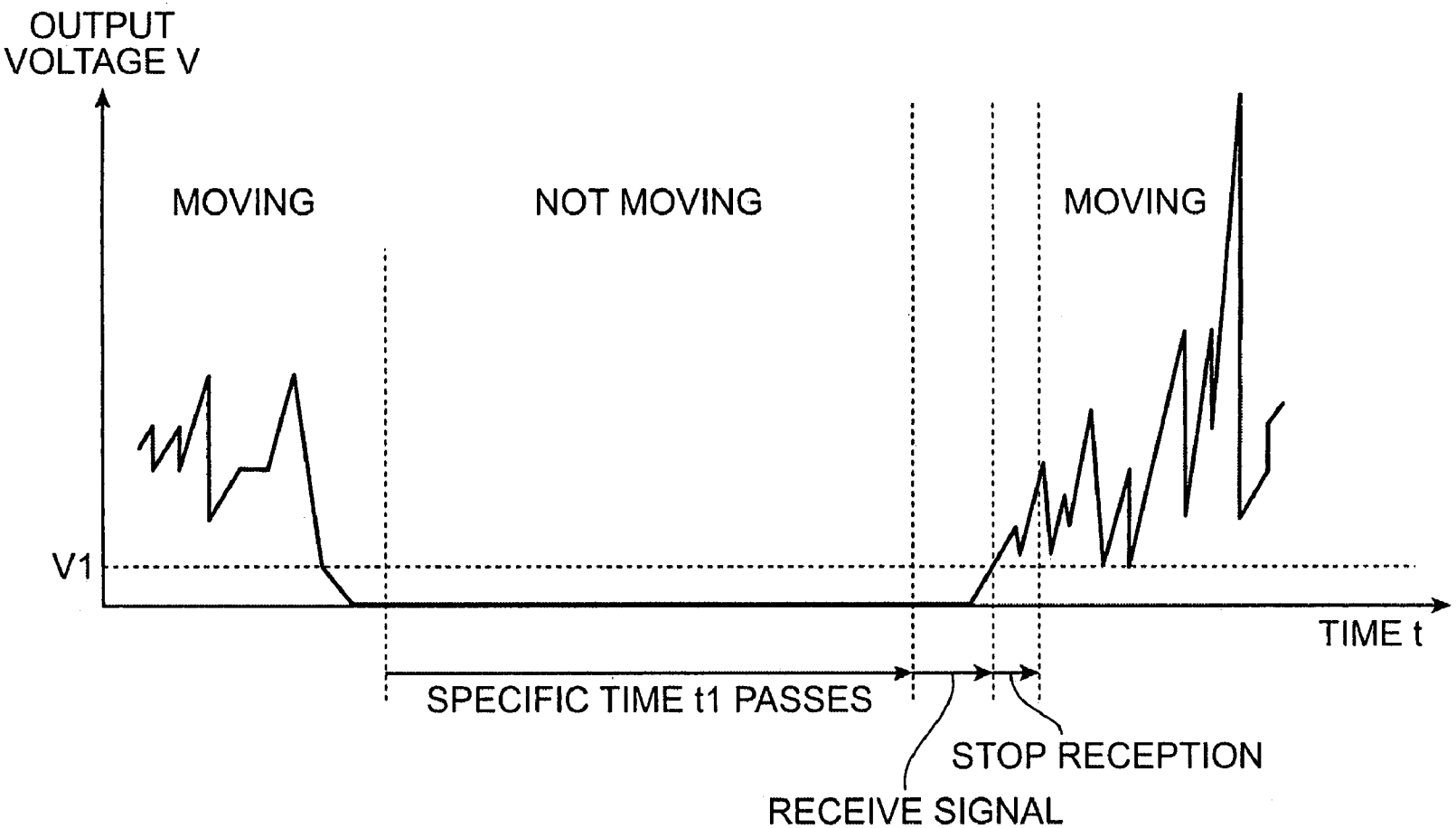
FIG. 14 shows the variation in output voltage over time by the power generating means in the second embodiment of the invention.

If the output voltage V of the generating means 4 (4B) is greater than or equal to the specified threshold voltage V1 (step S35 returns no), the decision unit 52 determines that the radio-controlled timepiece 1 is being worn and is moving, and outputs the motion detection signal to the control circuit 7. The reception operation stopping means of the control circuit 7 therefore stops (interrupts) reception of the standard time signal by the receiver 2 (reception stopping step) (step S38) as shown in FIG. 14, the reception schedule is then reset (step S39), and the time adjustment operation ends.

If the receiver 2 outputs the reception completion signal. (step S36 returns yes), the control circuit 7 drives the hands 311 based on the time information decoded from the received standard time signal as described in the first embodiment to adjust the displayed time (time adjustment step) (step S37), and the time adjustment operation then ends.

In addition to benefits (1) to (4) of the first embodiment described above, this second embodiment of the invention provides the following effects.

(6) By using the generating means 4 (4B), which is an electromechanical generating means that produces power by means of a rotary pendulum 41 that rotates when the radio-controlled timepiece 1 is worn and moved, as the motion detection means 5, whether the radio-controlled timepiece 1 is moving can be directly detected by monitoring the output voltage of the generating means 4 (4B). Whether the timepiece is moving can therefore be detected more accurately, and the reliability of standard time signal reception can be improved.

Furthermore, because the motion detection means 5 monitors whether the output voltage of the generating means 4

(4B) is greater than or equal to a specified threshold voltage V1 during a 10 minute period, calculating the average variation in the output voltage as described in the first embodiment is not necessary, and the construction of the decision unit 52 can therefore be simplified.

Yet further, because the motion detection means 5 uses the output voltage of the generating means 4 (4B) to detect if the timepiece is moving, the motion detection means 5 can be constructed using the generating means 4 (4B). The arrangement of the motion detection means 5 can thus be simplified and the parts count can be reduced, thus affording a smaller radio-controlled timepiece 1.

(7) Needless reception operation can also be prevented and the power consumption of the radio-controlled timepiece 1 can be reduced because the motion detection means 5 continues detecting movement of the timepiece while the receiver 2 is receiving the standard time signal, and reception is interrupted if movement of the radio-controlled timepiece 1 is detected.

More particularly, when the generating means 4 (4B) has a coil 43C and produces power through an induction current, a magnetic field is produced by the induction current of the generating coil 43C when the generating means 4 (4B) is producing power. This magnetic field affects the performance of the antenna 21, and can prevent the time information from being received. Receiving an inaccurate standard time signal can thus be prevented, and the reliability of standard time signal reception can be improved, by thus preventing standard time signal reception when power is being generated, that is, when the radio-controlled timepiece 1 is being worn and is moving.

Third Embodiment

A third embodiment of the present invention is described next below. This third embodiment of the invention differs from the radio-controlled timepiece 1 of the second embodiment by additionally having a power conservation function.

The power conservation function in this embodiment of the invention monitors the supply voltage of the power supply 8, and if the supply voltage is less than or equal to a specified threshold value functions to reduce power consumption by, for example, stopping movement of the hands 311 until the supply voltage recovers or use resumes. Note that the control circuit 7 is driven when the power conservation function is active so that the supply voltage can be monitored, for example.

The control circuit 7 has a power conservation circuit not shown that provides the power conservation function. The power conservation circuit monitors the supply voltage of the power supply 8, and outputs a power conservation signal to the control circuit 7 if the supply voltage drops below the threshold voltage V0. When power is generated by the generating means 4 (4A), the power conservation circuit also outputs a power conservation cancellation signal to the control circuit 7. The threshold voltage V0 can be desirably set according to the specifications and application of the radio-controlled timepiece 1, and is set to 1.2 V in this embodiment of the invention.

Figure 15:
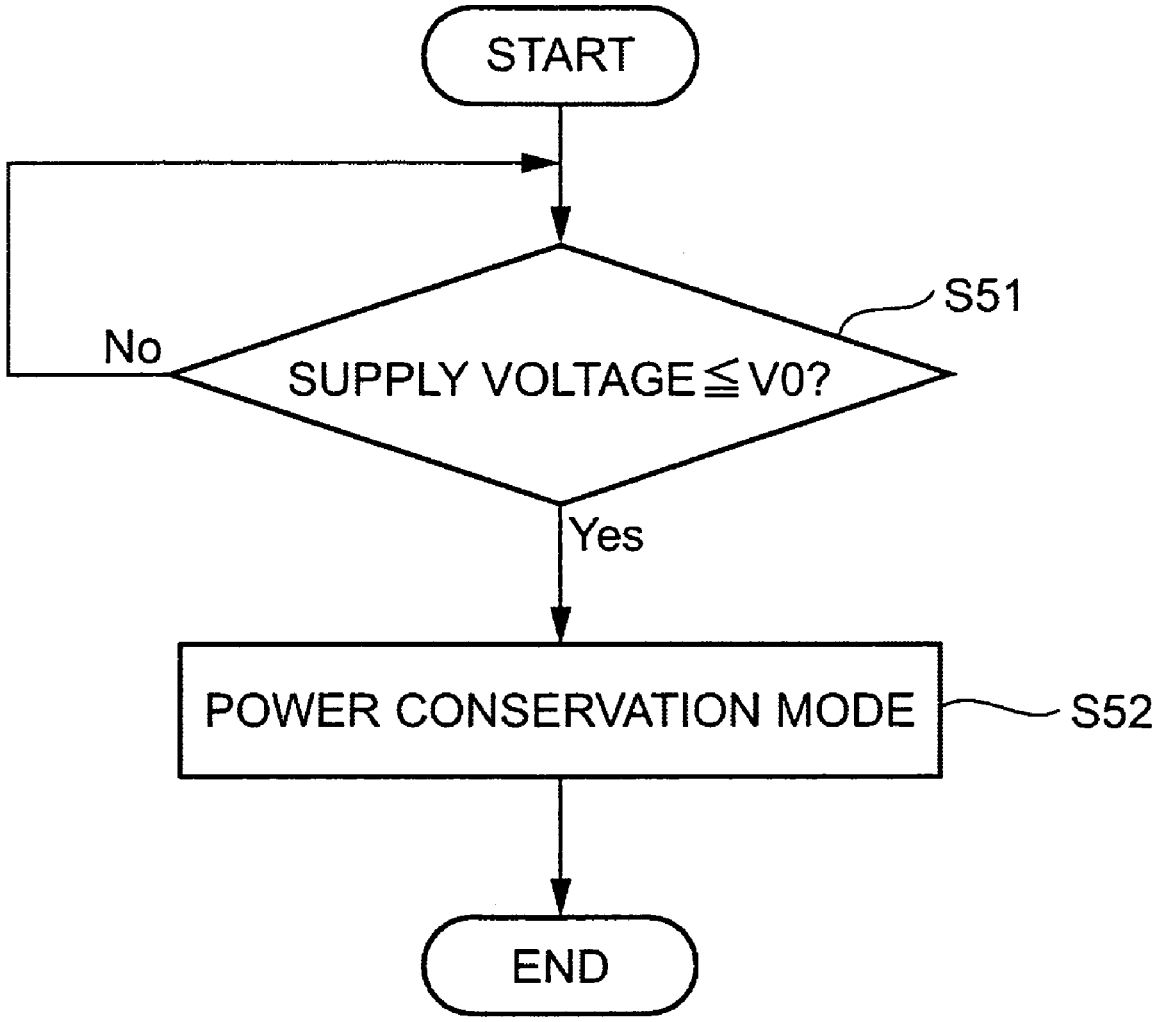
FIG. 15 is a flow chart describing the operation of the radio-controlled timepiece in a third embodiment of the invention.

FIG. 15 is a flow chart of radio-controlled timepiece 1 operation when the power conservation function is active. As shown in FIG. 15, the power conservation circuit monitors the supply voltage of the power supply 8 in step S51. If the supply voltage is greater than threshold voltage V0 (step S51 returns no), step S51 repeats and monitoring the supply voltage continues.

If the supply voltage goes to threshold voltage V0 or less (step S51 returns yes), the power conservation circuit sends a power conservation signal to the control circuit 7 (step S52) When the power conservation signal is applied to the control circuit 7, the control circuit 7 stops signal output to the timepiece drive unit 32. Driving the timepiece drive unit 32 thus stops, moving the hands 311 stops, and the radio-controlled timepiece 1 enters the power conservation mode. If the drive unit 32 for the second hand is separate from the drive unit 32 for the minute hand and hour hand, the power conservation mode could be arranged to stop only movement of the second hand.

Figure 16:
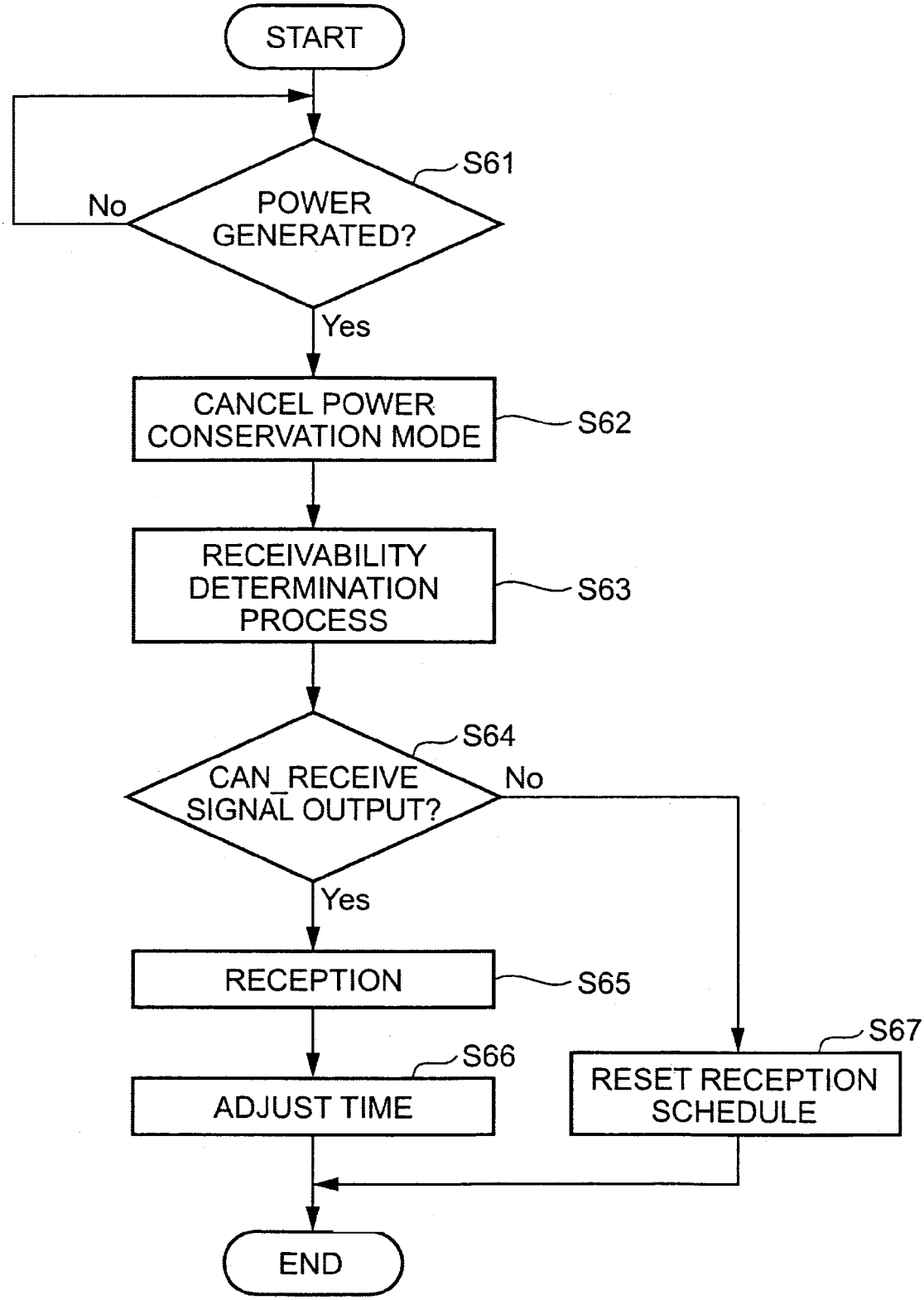
FIG. 16 is a flow chart describing the operation of the radio-controlled timepiece in a third embodiment of the invention.

FIG. 16 is a flow chart showing operation of the radio-controlled timepiece 1 when the power conservation mode is cancelled. As shown in FIG. 16, the power conservation circuit continues to monitor voltage output by the generating means 4 (4A) even when the radio-controlled timepiece 1 is in the power conservation mode (step S61). If the output voltage of the generating means 4 (4A) is detected (step S61 returns yes), the power conservation circuit outputs a power conservation mode cancellation signal to the control circuit 7 (step S62).

The control circuit 7 then resumes signal output to the timepiece drive unit 32, corrects the time displayed by the hands 311 based on the current time kept by the internal counter, and runs the receivability determination process in step S63. As in the second embodiment, the receivability determination process includes the day/night determination step run by the day/night determination means, the location detection step run by the location detection means 6, and the movement detection step run by the motion detection means 5.

If the out_of_reception_range detection signal or the motion detection signal is output, that is, the cannot_receive signal is output (step S64 returns no), the reception blocking means of the control circuit 7 prevents standard time signal reception by the receiver 2 (no_reception step), the reception schedule is reset in the reception schedule control unit in step S67, and the time adjustment operation then ends.

However, if the not_moving detection signal, that is, the can_receive signal was output (step S64 returns yes), the reception driving means of the control circuit 7 drives the receiver 2 to receive the standard time signal through the antenna 21 (step S65, reception step), and the time displayed by the hands 311 is then adjusted in step S66 (time adjustment step).

If the standard time signal is not received when the power conservation mode is cancelled, the next reception schedule is preferably set to an interval shorter than the normal reception schedule, and in this embodiment of the invention the next reception schedule is therefore reset to one hour and thirty minutes later.

In addition to effects (1) to (4) of the first embodiment, and effects (6) and (7) of the second embodiment, this third embodiment of the invention also has the following effect.

(8) Having a power conservation circuit, the radio-controlled timepiece 1 decides whether the standard time signal can be received by executing the day/night determination step, location detection step, and movement detection step when the power conservation mode is cancelled. Compared with the conventional method of unconditionally receiving the standard time signal immediately after the power conservation mode is cancelled, this embodiment of the invention affords more stable reception performance and improves reception reliability.

Power consumption by the radio-controlled timepiece 1 can also be reduced because reception is prevented when reception is likely to fail. Radio-controlled timepieces having a power conservation function typically have the power conservation function to reduce power consumption when the battery capacity is low, for example. In addition, the power conservation mode is normally set when the supply voltage drops and the remaining voltage is low. Forcing reception after the power conservation mode is cancelled even though the timepiece is located where the signal cannot be received in such situations simply wastes more power. A radio-controlled timepiece 1 according to this embodiment of the invention, however, only receives the signal after determining that the standard time signal can be received, therefore does not waste power, and thus promotes low energy consumption in a radio-controlled timepiece 1.

The location detection means 6 and motion detection means 5 of a radio-controlled timepiece 1 according to this embodiment of the invention determine whether the standard time signal can be received before the control circuit 7 starts the reception operation. Therefore, if the power conservation circuit is configured to receive the standard time signal at a specified interval even while the power conservation mode is active, this embodiment of the invention is particularly effective because wasteful reception operations can be avoided while the power conservation mode is active and power consumption by the radio-controlled timepiece can thus be greatly reduced if the location detection and motion detection operations are executed before reception begins.

Fourth Embodiment

A fourth embodiment of the present invention is described next. This fourth embodiment differs from the first embodiment in that the reception schedule is set differently in the reception schedule control unit of the radio-controlled timepiece 1.

The reception schedule control unit has a reception counter (not shown in the figure) for counting the number of times standard time signal reception succeeds. The reception schedule control unit is set in this embodiment to output a time adjustment operation start command at one hour intervals.

Figure 17:
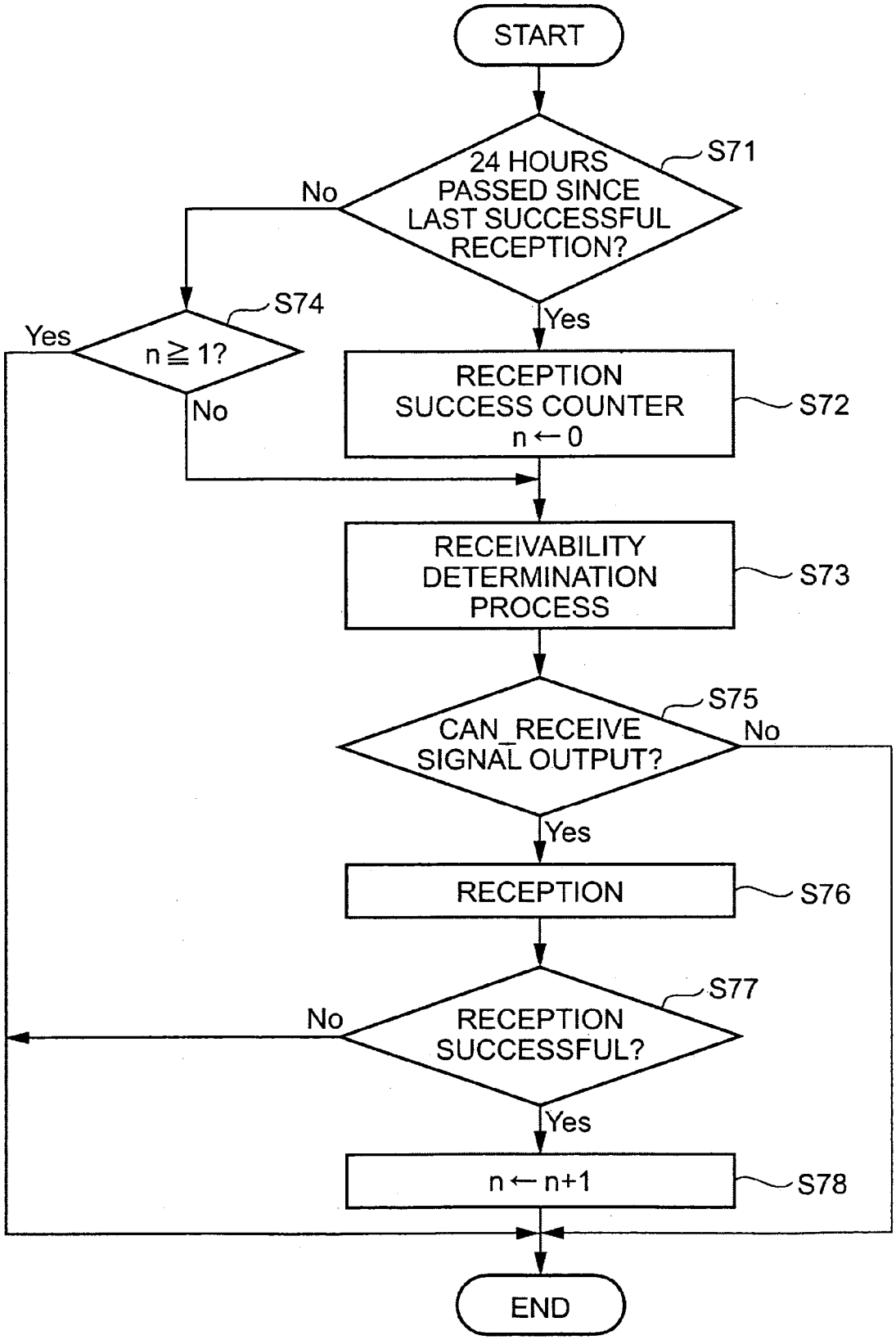
FIG. 17 is a flow chart describing the operation of the radio-controlled timepiece in a fourth embodiment of the invention.

FIG. 17 is a flow chart showing the operation of a radio-controlled timepiece 1 according to this fourth embodiment of the invention. As in the first embodiment and shown in FIG. 17, a time adjustment operation start command is output from the reception schedule control unit of this radio-controlled timepiece 1 at a predetermined time. When this start signal is received, the control circuit 7 determines if a specified time (24 hours in this embodiment) has passed since the last time that standard time signal reception succeeded (step S71). If 24 hours have passed (step S71 returns yes), the control circuit 7 resets the reception success count of the reception counter (step S72), and then runs the receivability determination process to determine if the standard time signal can be received (step S73).

If the current time is less than 24 hours after the last time that standard time signal reception was successful (step S71 returns no), the control circuit 7 determines if the reception success count n stored by the reception counter is greater than or equal to 1 (step S74). Because this is the first time that the time adjustment operation is run, the reception success counter n=0 (step S74 returns no), and the location detection means 6 and motion detection means 5 run the receivability determination process in step S73.

As described in the first embodiment, the receivability determination process run in step S73 includes a day/night determination step, location detection step, and movement detection step to determine if the radio-controlled timepiece 1 can receive the standard time signal. If the out_of_reception_range detection signal is output from the location detection means 6 or the motion detection signal is output from the motion detection means 5, that is, the cannot_receive signal was output (step S75 returns no), the time adjustment operation ends immediately without the control circuit 7 receiving the standard time signal.

If the not_moving detection signal was output, that is, the can_receive signal was output (step S75 returns yes), the receiver 2 receives the standard time signal and the control circuit 7 corrects the displayed time (step S76). The control circuit 7 then determines if reception was successful in step S77. If reception was successful (step S77 returns yes), the reception success count of the reception counter in the reception schedule control unit is incremented 1 (step S78), and the time adjustment operation ends.

If reception failed (step S77 returns no), the time adjustment operation ends without incrementing the reception success count of the reception counter.

The reception schedule control unit outputs the time adjustment operation start signal at one hour increments. However, if standard time signal reception has not succeeded even once within the previous 24 hours, steps S71 and S74 in the second and subsequent time adjustment operations both return no and the receivability determination process is executed in step S73. If the reception success count n is greater than or equal to 1 in step S74 (step S74 returns yes), the standard time signal was correctly received within the previous 24 hours, the time was therefore corrected, receiving the standard time signal again is not necessary, and the time adjustment operation thus ends.

The standard time signal is thus received and the time is adjusted once in an approximately 24 hour period with the foregoing operation of a radio-controlled timepiece 1.

In addition to effects (1) to (5) of the first embodiment described above, this fourth embodiment of the invention also has the following effect.

(9) The reception schedule control unit thus has a reception counter to count the number of times n that reception succeeds, and can thus skip subsequent reception operations within a specified period of time if reception succeeds a specified number of times (once) within a specified period of time (24 hours). Therefore, when the reception schedule control unit is set to output the time adjustment operation start command at one hour intervals, whether reception is possible is determined every hour until reception succeeds, and the standard time signal can be received if reception is possible. The time can therefore be more accurately displayed even if reception has previously failed because reception is attempted again and the time is adjusted at a relatively short interval. Furthermore, once reception succeeds, signal reception is skipped for the next 24 hours. Receiving the standard time signal more frequently than necessary can thus be prevented, and power consumption by the radio-controlled timepiece 1 can be reduced.

The present invention shall not be limited to the embodiments described above, and variations and improvements that achieve the object of the present invention shall be included within the scope of the present invention.

The location detection means shall not be limited to a means of detecting the location of the radio-controlled timepiece 1 based on the output voltage of a photoelectric generating means as in the foregoing first embodiment. A light meter could be provided in a radio-controlled timepiece that does not have a photoelectric generating means, for example, to detect the location of the timepiece based on the ambient luminance. The location detection means could, for example, also use the global positioning system (GPS) of measuring a current position on Earth using radio signals transmitted from orbiting satellites. A radio-controlled timepiece that receives a longwave standard time signal to adjust the time can receive the standard time signal more easily than signals transmitted from the GPS satellites. The longwave standard time signal can therefore be received if the radio-controlled timepiece is located where the GPS satellite signals can be received and the location can be determined using the GPS signals. The location detection means can therefore be configured to detect the current location using the GPS, output the receivable_location detection signal if the current location can be determined, and output the out_of_reception_range detection signal if the current location cannot be determined.

Because the motion detection means 5 continues operating during reception by the receiver 2 in the second embodiment, whether or not the timepiece is moving need not always be checked before reception begins. The motion detection means could be configured to operate only during signal reception, and to stop reception when movement of the radio-controlled timepiece is detected, for example.

The day/night determination means of the location detection means uses 7:00 a.m. and 5:00 p.m. as daytime and 5:00 p.m. and 7:00 a.m. as nighttime, and sets different threshold values for evaluating the generator output voltage at day and night. The invention shall not be so limited, however, and the day and night time settings of the radio-controlled timepiece could be changed according to the season based on calendar information (date information) from the control means.

Furthermore, if a GPS location detection means such as described above is used, the day/night determination means could determine the season and time according to the latitude and longitude of the current location acquired from the GPS location information, and set the times for detecting day and night accordingly. This arrangement enables a correct day/night determination regardless of location when the user of the radio-controlled timepiece is travelling, for example.

The threshold values of the output voltage could also be changed based on the calendar information, or two different settings could be used for day and night, or threshold values could be desirably set in a desired number of multiple stages.

A motion detection means is also not always necessary. More specifically, the radio-controlled timepiece requires at least a location detection means, and the reception operation can be controlled based on the detection signal of the current location of the radio-controlled timepiece output by the location detection means.

Figure 18:
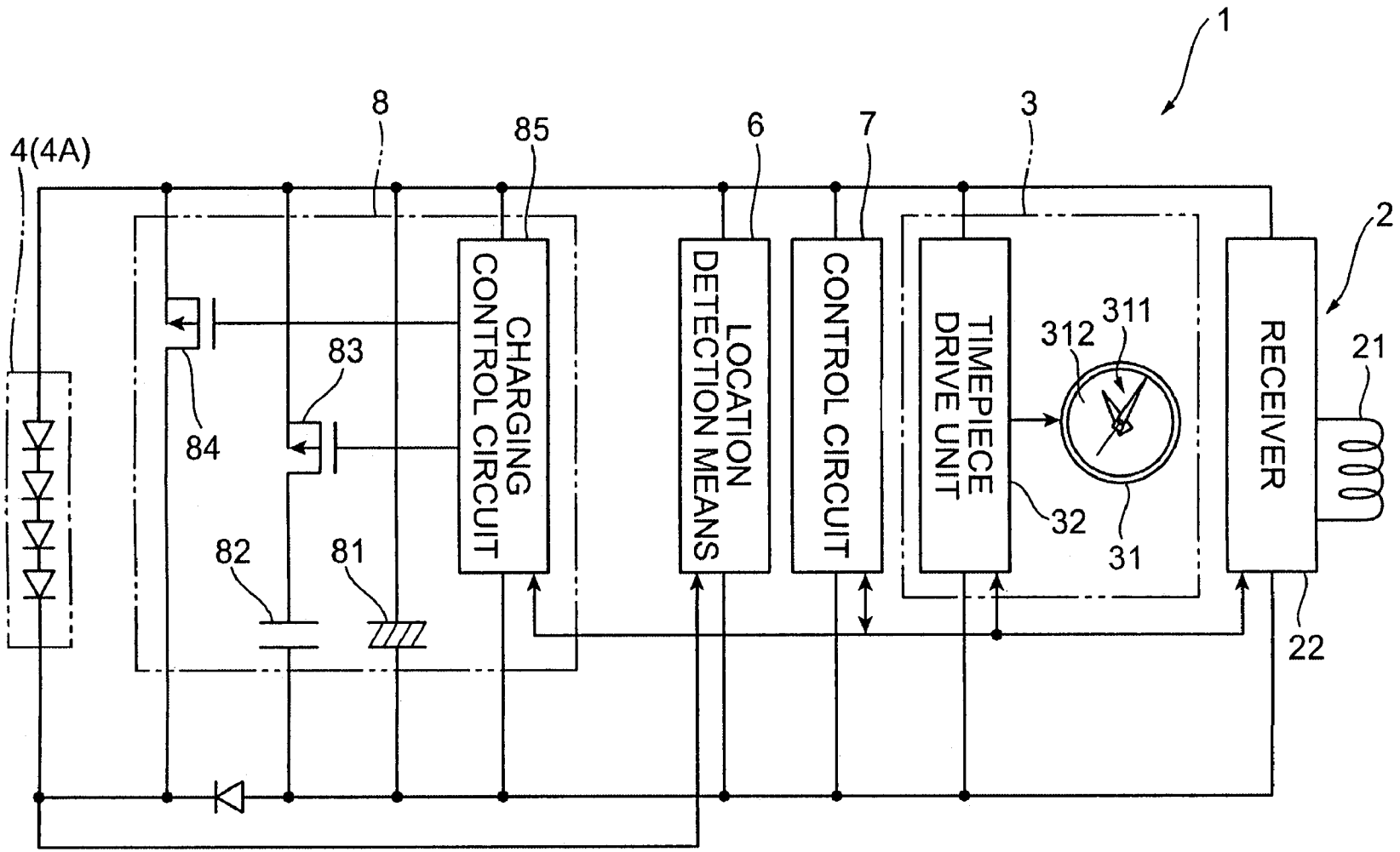
FIG. 18 is a function block diagram showing a variation of a radio-controlled timepiece according to the present invention.

FIG. 18 is a function block diagram of a radio-controlled timepiece 1 according to a variation of the present invention. As shown in FIG. 18, a motion detection means 5 as described in the foregoing embodiments is not provided in this -radio-controlled timepiece 1, and the reception operation control means of the control circuit 7 controls the standard time signal reception operation based on the detection signal of the current location of the radio-controlled timepiece 1 output by the location detection means 6.

Figure 19:
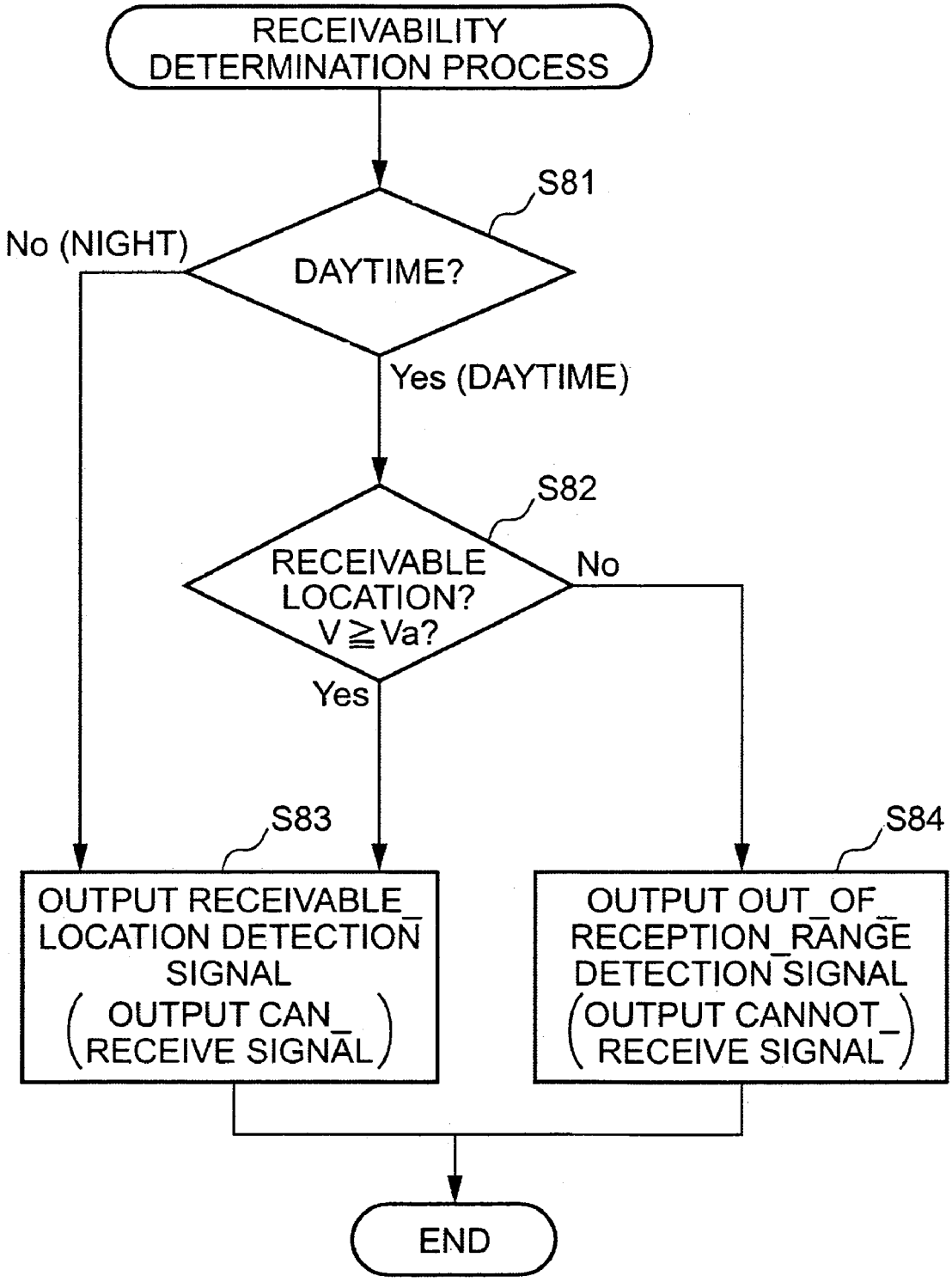
FIG. 19 is a flow chart describing the operation of the radio-controlled timepiece in this variation of the invention.

FIG. 19 is a flow chart showing the receivability determination process of the radio-controlled timepiece 1 in this variation of the invention. As shown in FIG. 19, the day/night determination means of the location detection means 6 determines whether the current time is day or night in step S81 (day/night determination step). If the current time is during the day (step S81 returns yes), control goes to step S82 and the location detection means 6 [5, sic] detects the current location of the radio-controlled timepiece 1 (location detection step). If the radio-controlled timepiece 1 is located where the standard time signal can be received (step S82 returns yes), control goes to step S83 and the location detection means 6 outputs a receivable_location detection signal (can_receive signal) to the control circuit 7. However, if in step S82 the radio-controlled timepiece 1 is located where the signal cannot be received (step S82 returns no), control goes to step S84 and the location detection means 6 outputs an out_of_reception_range detection signal (cannot_receive signal) to the control circuit 7.

If the day/night determination means determines in step S81 that the current time is night (step S81 returns no), the location detection means 6 does not detect the current location and in step S83 the location detection means 6 outputs the receivable_location detection signal (can_receive signal) to the control circuit 7.

Figure 20:
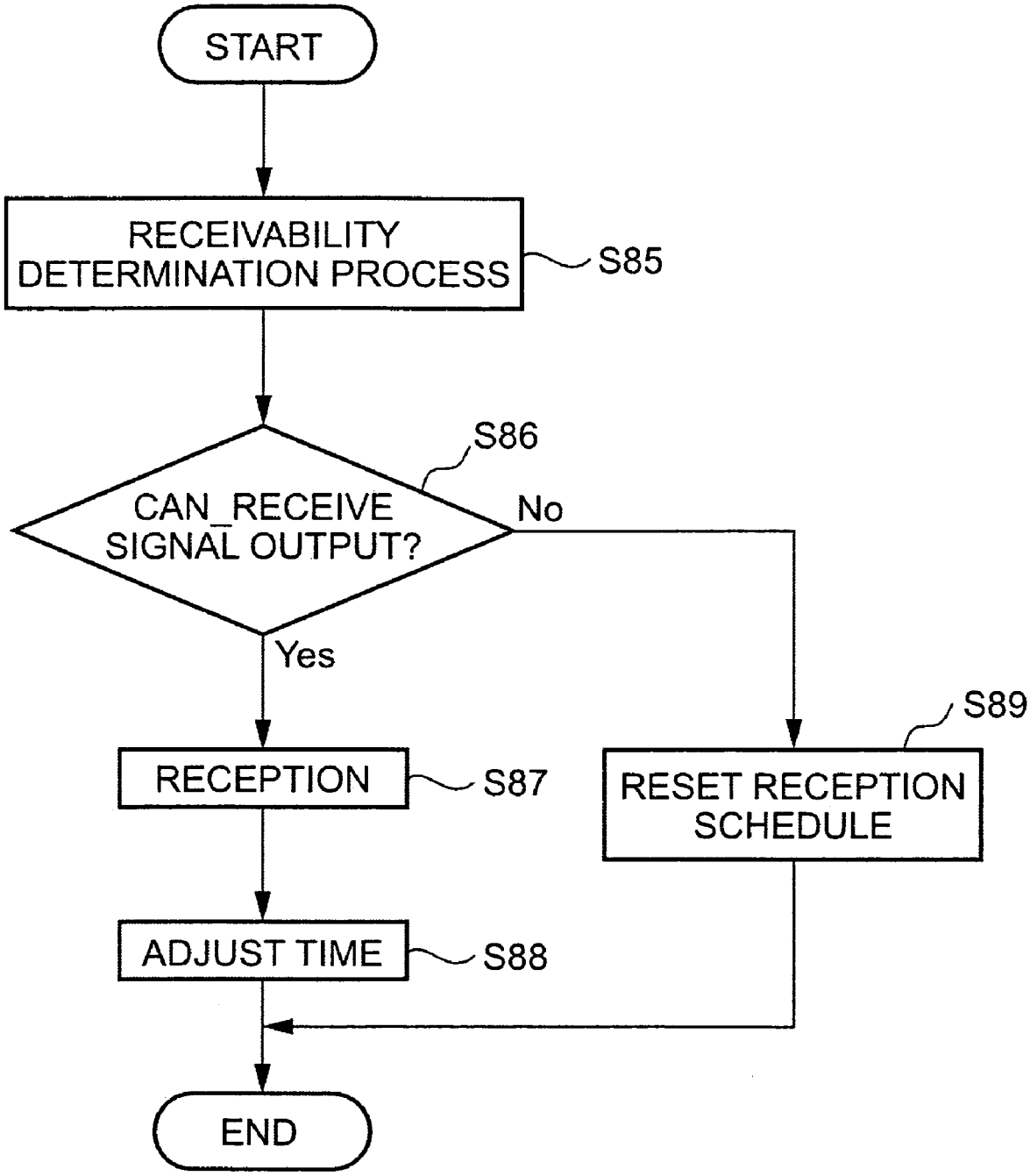
FIG. 20 is a flow chart describing the operation of the radio-controlled timepiece in this variation of the invention.

FIG. 20 is a flow chart showing the operation of the radio-controlled timepiece 1 according to this variation of the invention. As shown in FIG. 20, the receivability determination process shown in FIG. 19 is run first in step S85. The control circuit 7 then determines in step S86 if the receivable_location detection signal (can_receive signal) was output. If the receivable_location detection signal was output (step S86 returns yes), the reception means of the control circuit 7 receives the standard time signal (reception step) (step S87) and the time is adjusted in step S88 (time adjustment step).

If the out_of_reception_range detection signal (cannot_receive signal) was output (step S86 returns no), the reception blocking means of the control circuit 7 prevents reception (no_reception step), control goes to step S89, the reception schedule control unit resets the reception schedule, and the time adjustment operation ends.

The location detection means 6 thus detects the location of the radio-controlled timepiece 1 and the radio-controlled timepiece 1 controls standard time signal reception based on this detection signal. Reception precision can thus be improved, wasteful reception attempts can be prevented, and a more energy efficient radio-controlled timepiece 1 can be provided.

A motion detection means 5 detects motion during reception by the receiver 2 in the second embodiment, but the invention shall not be so limited. For example, the location detection means 6 could detect the current location during standard time signal reception, and standard time signal reception could be stopped (interrupted) if the location detection means 6 outputs the out_of_reception_range detection signal while the standard time signal is being received.

Figure 21:
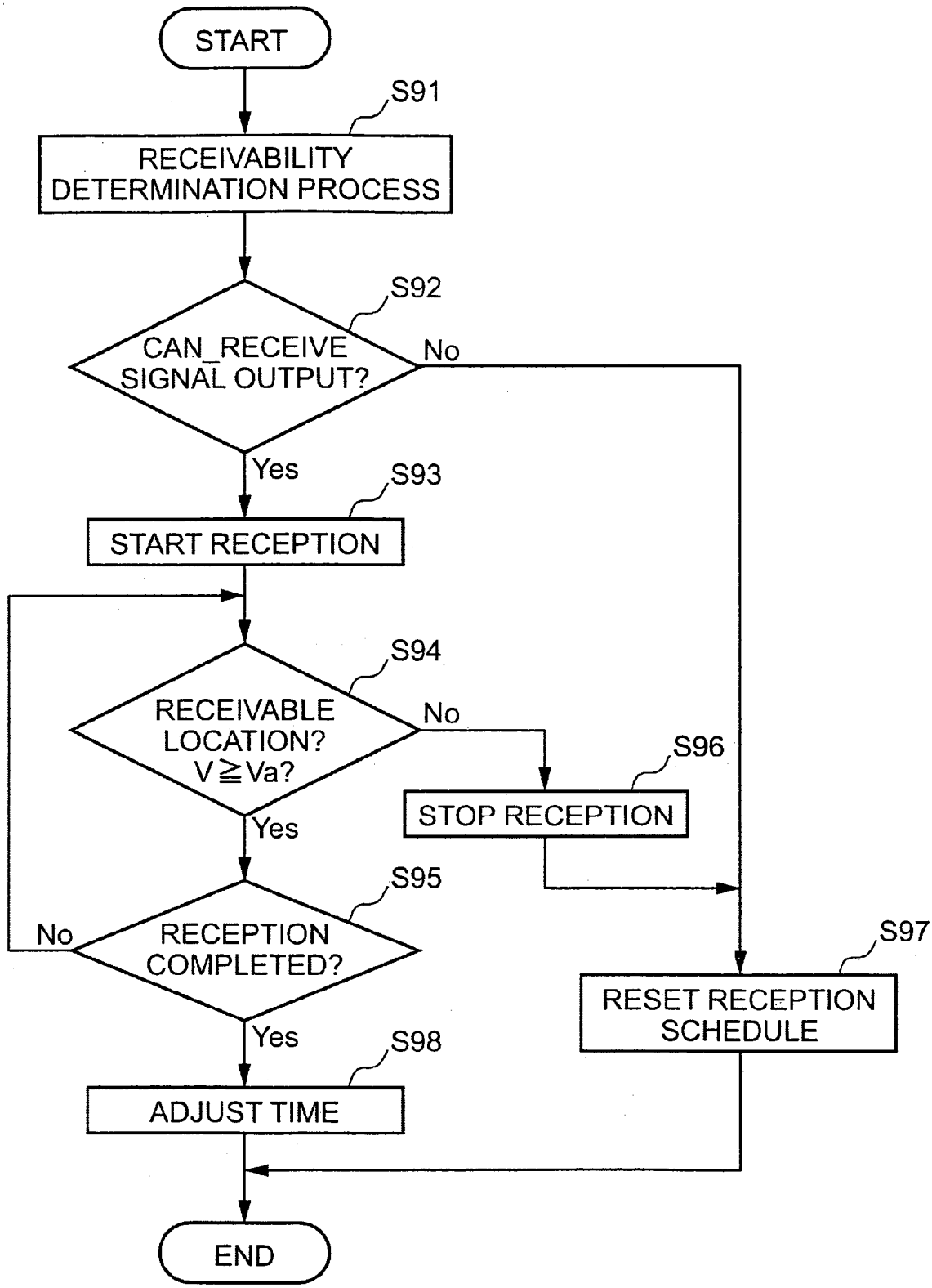
FIG. 21 is a flow chart describing the operation of the radio-controlled timepiece in another variation of the invention.

FIG. 21 is a flow chart showing the operation of the radio-controlled timepiece 1 in this variation of the invention. This radio-controlled timepiece 1 has the same configuration as shown in FIG. 18, and the control circuit 7 has a reception operation stopping means for stopping reception if the location detection means 6 outputs the out_of_reception_range detection signal while the standard time signal is being received.

As in the operation of the radio-controlled timepiece 1 described in FIG. 19, the receivability determination process in step S91 in FIG. 21 is run using only the location detection means 6 (location detection step). In step S92, the control circuit 7 determines if the location detection means 6 output the receivable_location detection signal (can_receive signal). If the receivable_location detection signal was output (step S92 returns yes), the reception means of the control circuit 7 causes the receiver 2 to start receiving the standard time signal (step S93)

If the location detection means 6 output the out_of_reception_range detection signal (cannot_receive signal) (step S92 returns no), control skips to step S97, the reception schedule control unit resets the reception schedule, and the time adjustment operation ends.

The location detection means 6 continues detecting the location of the radio-controlled timepiece 1 while the receiver 2 receives the standard time signal. The location detection means 6 runs the receivability determination process in step S94. If the receivable_location detection signal is output (step S94 returns yes), the reception means of the control circuit 7 continues reception by the receiver 2, and determines if reception has ended (step S95). If reception has not ended (step S95 returns no), step S94 repeats so that the location detection means 6 continues to detect the location while the standard time signal is being received.

If in step S94 the location detection means 6 outputs the out_of_reception_range detection signal while the receiver 2 is receiving the standard time signal (step S94 returns no), control goes to step S96 and the reception stopping means of the control circuit 7 stops (interrupts) the reception operation of the receiver 2 (reception stopping step). The reception schedule is then reset in step S97 as described above, and the time adjustment operation ends.

If in step S95 the reception completion signal is output from the receiver 2 (step S95 returns yes), the control circuit 7 adjusts the displayed time in step S98 (time adjustment step).

The location detection means 6 thus continues to detect the location of the radio-controlled timepiece 1 while the receiver 2 is receiving the standard time signal in this variation of the invention, and reception is interrupted if the radio-controlled timepiece 1 is moved to a location where the standard time signal cannot be received, for example. Wasteful reception operations can thus be prevented, and power conservation by the radio-controlled timepiece 1 can be improved.

The day/night determination operation of the day/night determination means shall not be limited to being run before the location detection operation of the location detection means. For example, the day/night determination means could differentiate day and night after the receivable_location detection signal has been output by the location detection means. The control means in this case could prevent receiving the external signal when the day/night determination means determines that it is day because there is much noise, and drive receiving the external signal if it is night because there is less noise and the likelihood of reception succeeding is higher.

The day/night determination process of the day/night determination means shall also not be limited to receiving the standard time signal without location detection if it is night. For example, the threshold value used by the location detection means to detect the location could be changed according to the day/night determination of the day/night determination means, and the location could be detected during both day and night using the appropriate threshold value. If the location detection means has a photoelectric generating means, for example, the threshold value could be change so that the power output required to determine that reception is possible could be set high during the day because the light indoors is relatively bright during the day, but the threshold value used at night is then set low because the available light is relatively dark even outdoors at night. After the day/night determination means makes the day/night determination in this case, the location of the radio-controlled timepiece is detected both during the day and during the night based on the respectively set threshold values, and the receivability determination process is run.

The radio-controlled timepiece is also not limited to receiving an external signal at a predetermined time, and could, for example, have a learning function that stores the living pattern of the user and runs the reception operation during hours when the likelihood of successfully receiving the external signal is high. This type of radio-controlled timepiece has a detection data acquisition means for gathering data from the location detection signals from the location detection means, and a scheduling means for setting the external signal reception schedule based on the data gathered by the data acquisition means. The detection data acquisition means detects the current location of the radio-controlled timepiece by means of the location detection means at a specific time, and collects detection signal data. This specific time can be set as desired, and data collection by the detection data acquisition means could be limited to only a period of days when the radio-controlled timepiece is first used.

The location detection signal collected by the detection data acquisition means is stored in a storage means and analyzed by the scheduling means. The scheduling means references the detection data and selects a time period in which the receivable_location detection signal output rate is high, and sets this time period in the reception schedule control unit of the control circuit as the time to start the reception operation.

This type of radio-controlled timepiece can thus set the reception schedule according to the living pattern of the user, thereby increase the likelihood of successful reception, and can thus receive external signals with high efficiency.

This detection data acquisition means is not limited to only collecting data from the timepiece location detection signals output by the location detection means, and could be arranged to also collect the motion detection signals from the motion detection means with the scheduling means setting the reception schedule based on the current location detection signals and motion detection signals.

When the location detection means detects the location as part of the reception process, the detection data acquisition means could also collect the detection results as detection data. Because location detection separate from the location detection executed for the reception operation is unnecessary in this case, data can be collected efficient1y and energy efficiency can thus be improved. Particularly when the radio-controlled timepiece runs the reception operation at a regularly scheduled time, detection data can be collected at each scheduled time in conjunction with the reception operation, thus enabling efficient data collection.

In the foregoing first embodiment the motion detection means outputs the not-moving detection signal when the average variation Vwa in the output voltage V from the generating means 4 in a ten minute period is less than or equal to 0.02 V/minute or 0.002 V/minute. The invention shall not be so limited, however, and the not_moving detection signal could be output if, for example, the average variation in the output voltage V in the first five minutes is 0.02 V/second or less and the average variation Vwa in the output voltage V in the next five minutes is 0.02 V/minute or less.

Instead of using the average variation Vwa in the output voltage V, the motion detection means could alternatively output the motion detection signal if the variation in the output voltage V is 0.02 V/minute or more even only once in the ten minute period.

In other words, the motion detection means is simply arranged to output the not_moving detection signal if the variation in the output voltage of the generating means is within a specific range during a specific time, and otherwise output the motion detection signal. Because the radio-controlled timepiece is determined to be moving at the point when the variation in the output voltage V equals or exceeds the particular threshold value, whether the timepiece is moving can be quickly and reliably determined, and response can be improved. Furthermore, because the motion status can be determined when a change in the output voltage equal to or greater than the threshold value is detected, power consumption can be reduced compared with calculating the average change over a period of time.

Even more specifically, the conditions used by the motion detection means to determine whether the timepiece is moving can be suitably set according to, for example, the usage conditions of the radio-controlled timepiece.

Yet further, the motion detection means 5 in the first embodiment outputs the not_moving detection signal when the average variation Vwa in the output of the generating means 4 (4A) is less than or equal to variation Vw, but the invention shall not be so limited. For example, the not_moving detection signal could be output if, in addition to monitoring the average variation Vwa in the power output, the output voltage V is greater than or equal to a specified level. In this case the output voltage Va used as the threshold value for location detection by the location detection means is also set as the specified value of the output voltage V.

In other words, as shown in FIG. 4, the output voltage Va used as the threshold value for location detection by the location detection means is also applied as a threshold value used by the motion detection means, and the motion detection means outputs the not_moving detection signal if the output voltage V or average output voltage V is greater than or equal to output voltage Va, and the average variation in the output voltage V is within the range of variation Vw. By thus detecting motion using the threshold value Va used for receivable location detection by the location detection means in addition to monitoring the average variation Vwa in the output voltage V, the motion status of the timepiece can be detected while also confirming that reception is possible. Whether or not the signal can be received can thus be more reliably determined.

The motion detection means shall not be limited to using the power output from a photoelectric generating means or the power output from an electromechanical generating means, and could be any type of electrical generating means, including a thermoelectric generating means. The motion detection means shall also not be limited to detecting the motion status based on the power output of the generating means. If the radio-controlled timepiece is a wristwatch, for example, whether the radio-controlled timepiece is being worn (moving) can be detected by detecting the body temperature from the wrist of the user.

The motion detection means could also detect motion by detecting change in the attitude of the radio-controlled timepiece. In this case an attitude change detection circuit (attitude change detection means) that is configured to, for example, detect the angle of the radio-controlled timepiece relative to the horizontal direction or switch a mechanical contact when the attitude of the timepiece changes, and a decision unit that determines the motion status of the radio-controlled timepiece from the detection signal from the attitude change detection circuit, are provided. The decision unit in this arrangement outputs the motion detection signal if the change in the detected angle output from the attitude change detection circuit is greater than or equal to a specific value. Because this arrangement can directly detect if the radio-controlled timepiece is moving, the evaluation conditions used by the decision unit can be easily set, whether the radio-controlled timepiece is moving can be effectively detected, and the reliability of standard time signal reception can be improved.

If an external operating means such as a crown or button is provided for forcing signal reception, the location detection means could detect the location of the radio-controlled timepiece and the motion detection means could detect if the radio-controlled timepiece is moving before receiving the standard time signal when the external operating means is operated.

The external signal received by the receiver shall not be limited to a longwave standard time signal, and could be a shortwave standard time signal or any other desired radio signal.

Furthermore, because the standard time signal can be accurately received insofar as the radio-controlled timepiece is not moving and the antenna orientation remains constant even if the radio-controlled timepiece is being worn, the specified time t1 used by the motion detection means can be shortened so that the standard time signal is received when the standard time signal is stationary even if the timepiece is being worn. This situation can also be considered stationary even though the radio-controlled timepiece is being worn because the radio-controlled timepiece itself is not moving.

Figure 22:
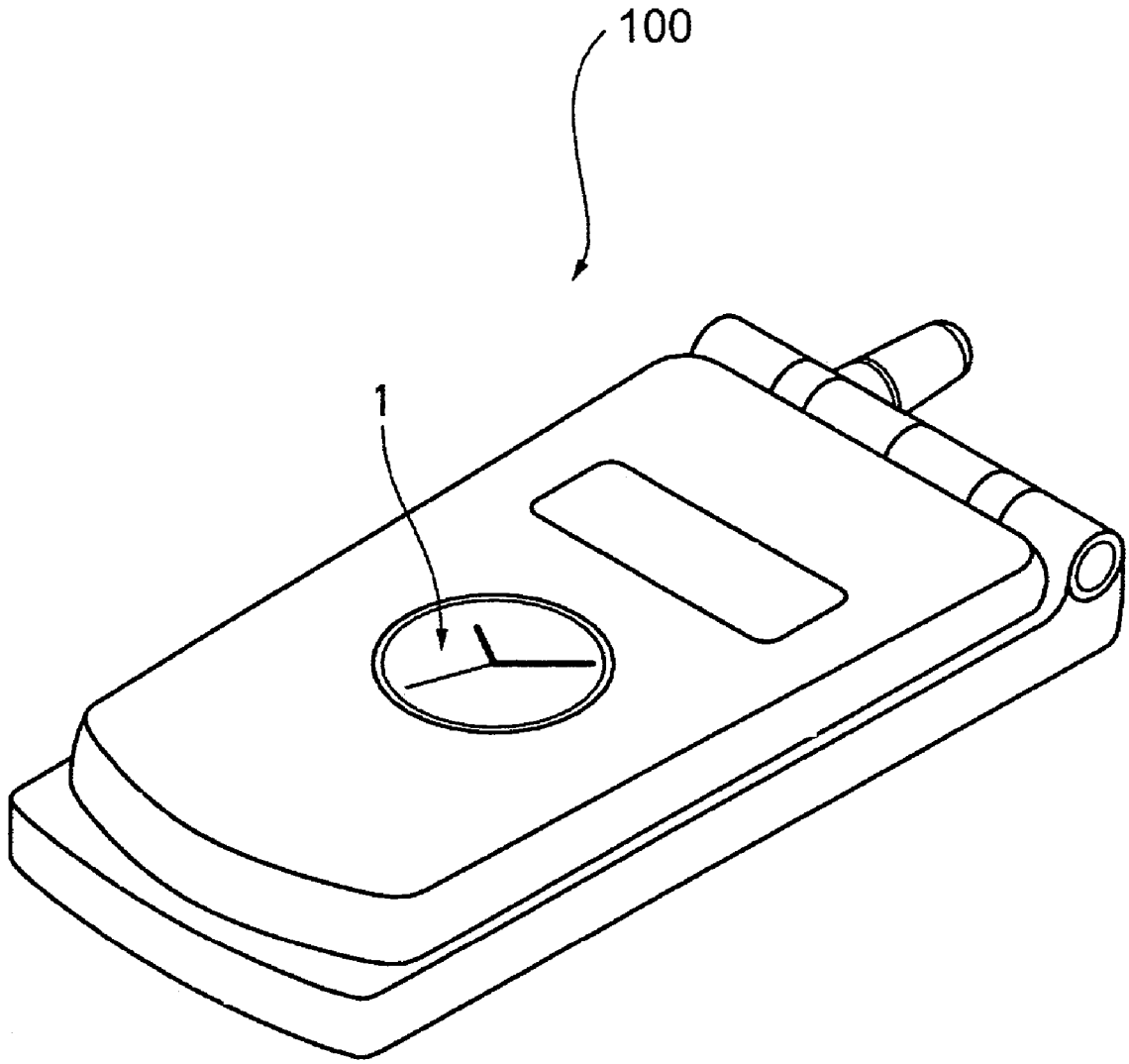
FIG. 22 shows an electronic device according to the present invention.

A radio-controlled timepiece according to the present invention can also be incorporated in an electronic device such as a personal computer or cell phone 100 such as shown in FIG. 22. Because the location changes when the electronic device moves and receiving the standard time signal becomes difficult when the electronic device is a portable device, for example, providing a radio-controlled timepiece having a location detection means according to the present invention for determining if reception is possible in the electronic device is particularly effective.

The display information control unit of the present invention could be a hardware configuration assembled inside the radio-controlled timepiece, but if the radio-controlled timepiece has a computer function, i.e., a CPU, memory, and hard disk drive, the display information control unit can be achieved in software by installing a control program from a CD-ROM or other recording medium or from the Internet or other communication means.

Other aspects of the present invention are shown below.

A first aspect of the invention is a control method for a radio-controlled timepiece that adjusts the displayed time based on an external signal containing time information. This control method has a location detection step of detecting the current location of the radio-controlled timepiece and outputting a location detection signal indicating if the radio-controlled timepiece is located in a position where the external signal can be received or is located in a position where the external signal cannot be received; a reception step of receiving the external signal; and a time adjustment step of adjusting the displayed time based on time information in the external signal received in the reception step. The reception step has a reception operation control routine for controlling receiving the external signal based on the radio-controlled timepiece location detection signal output in the location detection step when the external signal is received.

A second aspect of the invention is a control method for a radio-controlled timepiece as described in the foregoing first aspect wherein the location detection step has a receivability determination signal output routine that outputs a receivable_location detection signal as the location detection signal when the radio-controlled timepiece is determined to be located in a position where the external signal can be received, and outputs an out_of_reception_range detection signal as the location detection signal when the radio-controlled timepiece is determined to be located in a position where the external signal cannot be received. In addition, the reception step has a reception operation routine for receiving the external signal when the receivable_location detection signal is output for the radio-controlled timepiece in the location detection step.

A third aspect of the invention is a control method for a radio-controlled timepiece as described in the foregoing first aspect wherein the location detection step has a receivability determination signal output routine that outputs a receivable_location detection signal as the location detection signal when the radio-controlled timepiece is determined to be located in a position where the external signal can be received, and outputs an out_of_reception_range detection signal as the location detection signal when the radio-controlled timepiece is determined to be located in a position where the external signal cannot be received. In addition, the reception step has a reception stopping routine for stopping the reception operation if the out_of_reception_range detection signal is output for the radio-controlled timepiece in the location detection step while the external signal is being received.

A fourth aspect of the invention is a radio-controlled timepiece control method as described in any of the foregoing first to third aspects further comprising a motion detection step of detecting if the radio-controlled timepiece is moving, outputting a motion detection signal if the radio-controlled timepiece is determined to be moving, and outputting a not_moving detection signal if the radio-controlled timepiece is determined to not be moving. The location detection step has a receivability determination signal output routine that outputs a receivable_location detection signal as the location detection signal when the radio-controlled timepiece is determined to be located in a position where the external signal can be received, and outputs an out_of_reception_range detection signal as the location detection signal when the radio-controlled timepiece is determined to be located in a position where the external signal cannot be received. The reception step has a reception operation routine for receiving the external signal when the receivable_location detection signal is output in the location detection step and the not_moving detection signal is output in the motion detection step when the external signal is to be received.

A fifth aspect of the invention is a reception control program for a radio-controlled timepiece for causing a computer, which is incorporated in a radio-controlled timepiece having a reception unit for receiving an external signal carrying time information and a time display means for displaying the time based on a reference signal, to function as a control means having a location detection means for detecting the current location of the radio-controlled timepiece and outputting a location detection signal indicating if the radio-controlled timepiece is located where the external signal can be received or is located where the external signal cannot be received. The control means controls operation of the time display means, and controls the reception operation of the reception unit based on the radio-controlled timepiece location detection signal from the location detection means.

The best configurations and methods of achieving the present invention are described above, but the invention shall not be limited thereto. More specifically, the present invention is shown in the figures and described above with reference to particular embodiments of the invention, but the form, material, quantity, and other detailed aspects of the foregoing embodiments of the invention can be varied by one with ordinary skill in the related art without departing from the technical concept and object of the present invention.

Therefore, any description of the form, material, or other limiting aspects of the foregoing embodiments is given by way of example only for ease of understanding and shall not limit the scope of the present invention, and descriptions using names of parts that remove part or all of the form, material, or other limitations are also included in the scope of the present invention.

What is claimed is:

1. A radio-controlled timepiece having a time display for displaying time based on a reference signal, and that is capable of adjusting the displayed time based on an external signal containing time information, the radio-controlled timepiece comprising:

a reception unit configured to receive the external signal;

a location detector configured to estimate the ability of the reception unit to receive the external signal independent of actual reception of the external signal by the reception unit by detecting the current location of the radio-controlled timepiece and outputting a location detection signal indicating whether or not the radio-controlled timepiece is estimated to be located where the external signal can be received by the reception unit; and a controller configured to control operation of the reception unit, the controller comprising a reception operation controller configured to control reception operation of the reception unit based on the location detection signal output from the location detector.

2. A radio-controlled timepiece as described in claim 1, wherein the location detector outputs a receivable_location detection signal as the location detection signal if the radio-controlled timepiece is determined to be located where the external signal can be received, and outputs an out_of_reception_range detection signal as the location detection signal if the radio-controlled timepiece is determined to be located where the external signal cannot be received; and the controller comprises a reception driver configured to enable reception operation of the reception unit if the receivable_location detection signal is output from the location detector, and a reception blocker configured to block reception operation of the reception unit if the out_of_reception_range detection signal is output, when the reception unit receives the external signal.

3. A radio-controlled timepiece as described in claim 1, wherein the location detector outputs a receivable_location detection signal as the location detection signal if the radio-controlled timepiece is determined to be located where the external signal can be received, and outputs an out_of_reception_range detection signal as the location detection signal if the radio-controlled timepiece is determined to be located where the external signal cannot be received; and the controller comprises a reception operation stopper configured to stop reception operation of the reception unit if the out_of_reception_range detection signal is received from the location detector while the external signal is being received by the reception unit.

4. A radio-controlled timepiece as described in claim 1, further comprising a photoelectric generator configured to generate power by converting light energy to electrical energy;

wherein the location detector outputs a receivable_location detection signal as the location detection signal if the radio-controlled timepiece is determined to be located where the external signal can be received, and outputs an out_of_reception range detection signal as the location detection signal if the radio-controlled timepiece is determined to be located where the external signal cannot be received, and wherein the location detector outputs the receivable_location detection signal to the controller when power output by the photoelectric generator is greater than or equal to a specific value, and otherwise outputs the out_of_reception range detection signal.

5. A radio-controlled timepiece as described in claim 4, wherein the location detector comprises a day/night determination module configured to determine if the current time is during day or during night based on current time information received from the controller, and a threshold value setting module configured to change the threshold value for radio-controlled timepiece location detection based on the day/night determination from the day/night determination module.

6. A radio-controlled timepiece as described in claim 1, further comprising a motion detector configured to (i) detect if the radio-controlled timepiece is moving, (ii) output a motion detection signal if the radio-controlled timepiece is determined to be moving, and (iii) output a not_moving detection signal if the radio-controlled timepiece is determined to be stationary;

wherein the location detector outputs a receivable_location detection signal as the location detection signal if the radio-controlled timepiece is determined to be located where the external signal can be received, and outputs an out_of_reception_range detection signal as the location detection signal if the radio-controlled timepiece is determined to be located where the external signal cannot be received; and wherein the controller comprises a reception driver configured to enable reception operation of the reception unit if the receivable_location detection signal is output from the location detector and the not_moving detection signal is output from the motion detector when the reception unit receives the external signal.

7. A radio-controlled timepiece as described in claim 6, further comprising a generator configured to generate power by converting external energy to electrical energy; and wherein the motion detector comprises a power generation detector configured to detect the generating status of the generator, and a decision unit configured to determine if the radio-controlled timepiece is moving or not based on a detection signal received from the power generation detector.

8. A radio-controlled timepiece as described in claim 7, wherein the generator is a photoelectric generator that generates power by converting light energy to electrical energy; and the motion detector comprises an output unit that outputs the not_moving detection signal if variation in the power output of the generator is within a specific range for a specific time, and otherwise outputs the motion detection signal.

9. A radio-controlled timepiece as described in claim 7, wherein the generator is a photoelectric generator that generates power by converting light energy to electrical energy; and the motion detector comprises an output unit that outputs the not_moving detection signal if the average variation in the power output of the generator is within a specific range for a specific time, and otherwise outputs the motion detection signal.

10. A radio-controlled timepiece as described in claim 7, wherein the generator is an electromechanical generator that generates power by converting mechanical energy resulting from the radio-controlled timepiece being worn to electrical energy; and the motion detector comprises an output unit that outputs the not_moving detection signal if the power output of the generator is less than or equal to a specific value at a specific time, and otherwise outputs the motion detection signal.

11. A radio-controlled timepiece as described in claim 6, wherein the motion detector comprises an attitude change detector configured to detect a change in the attitude of the radio-controlled timepiece, and a decision unit configured to determine if the radio-controlled timepiece is moving based on the detection signal from the attitude change detector.

12. A radio-controlled timepiece as described in claim 6, wherein the motion detector comprises a reception operation linking module that operates in conjunction with the external signal reception operation of the reception unit.

13. A radio-controlled timepiece as described in claim 1, further comprising a motion detector configured to (i) detect if the radio-controlled timepiece is moving, (ii) output a motion detection signal if the radio-controlled timepiece is determined to be moving, and (iii) output a not_moving detection signal if the radio-controlled timepiece is determined to be stationary; and wherein the controller comprises a reception operation stopper configured to stop reception operation of the reception unit if the motion detection signal is received from the motion detector while the external signal is being received by the reception unit.

14. A radio-controlled timepiece as described in claim 13, further comprising a generator configured to generate power by converting external energy to electrical energy; and wherein the motion detector comprises a power generation detector configured to detect the generating status of the generator, and a decision unit configured to determine if the radio-controlled timepiece is moving or not based on a detection signal from the power generation detector.

15. A radio-controlled timepiece as described in claim 14, wherein the generator is a photoelectric generator that generates power by converting light energy to electrical energy; and the motion detector comprises an output unit that outputs the not_moving detection signal if variation in the power output of the generator is within a specific range for a specific time, and otherwise outputs the motion detection signal.

16. A radio-controlled timepiece as described in claim 14, wherein the generator is a photoelectric generator that generates power by converting light energy to electrical energy; and the motion detector comprises an output unit that outputs the not_moving detection signal if the average variation in the power output of the generator is within a specific range for a specific time, and otherwise outputs the motion detection signal.

17. A radio-controlled timepiece as described in claim 14, wherein the generator is an electromechanical generator that generates power by converting mechanical energy resulting from the radio-controlled timepiece being worn to electrical energy; and the motion detector comprises an output unit that outputs the not_moving detection signal if the power output of the generator is less than or equal to a specific value at a specific time, and otherwise outputs the motion detection signal.

18. A radio-controlled timepiece as described in claim 13, wherein the motion detector comprises an attitude change detector configured to detect a change in the attitude of the radio-controlled timepiece, and a decision unit configured to determine if the radio-controlled timepiece is moving based on the detection signal from the attitude change detector.

19. A radio-controlled timepiece as described in claim 13, wherein the motion detector comprises a reception operation linking module that operates in conjunction with the external signal reception operation of the reception unit.

20. An electronic device comprising a radio-controlled timepiece as described in claim 1.

21. A control method for a radio-controlled timepiece that adjusts the displayed time based on an external signal containing time information, comprising the steps of:

detecting the current location of the radio-controlled timepiece independent of actual reception of the external signal and outputting a location detection signal indicating whether or not the radio-controlled timepiece is estimated to be located in a position where the external signal can be received;

receiving the external signal; and adjusting the displayed time based on time information in the external signal received in the receiving step;

wherein the receiving step includes performing a reception operation control routine that controls the receiving of the external signal based on the radio-controlled timepiece location detection signal output in the location detecting step when the external signal is received.

22. A radio-controlled timepiece control method as described in claim 21, wherein the location detecting step includes performing a receivability determination signal output routine that outputs a receivable_location detection signal as the location detection signal if the radio-controlled timepiece is determined to be located in a position where the external signal can be received, and outputs an out_of_reception_range detection signal as the location detection signal if the radio-controlled timepiece is determined to be located in a position where the external signal cannot be received; and the receiving step includes performing a reception operation routine for receiving the external signal if the receivable_location detection signal is output for the radio-controlled timepiece in the location detecting step.

23. A radio-controlled timepiece control method as described in claim 21, wherein the location detecting step includes a receivability determination signal output routine that outputs a receivable_location detection signal as the location detection signal if the radio-controlled timepiece is determined to be located in a position where the external signal can be received, and outputs an out_of_reception_range detection signal as the location detection signal if the radio-controlled imepiece is determined to be located in a position where the external signal cannot be received; and the receiving step includes a reception stopping routine for stopping the reception operation if the out_of_reception_range detection signal is output for the radio-controlled timepiece in the location detection step while the external signal is being received.

24. A radio-controlled timepiece control method as described in claim 21, further comprising the steps of detecting if the radio-controlled timepiece is moving, outputting a motion detection signal if the radio-controlled timepiece is determined to be moving, and outputting a not_moving detection signal if the radio-controlled timepiece is determined to not be moving;

wherein the location detecting step includes a receivability determination signal output routine that outputs a receivable_location detection signal as the location detection signal if the radio-controlled timepiece is determined to be located in a position where the external signal can be received, and outputs an out_of_reception_range detection signal as the location detection signal if the radio-controlled timepiece is determined to be located in a position where the external signal cannot be received; and wherein the receiving step includes a reception operation routine for receiving the external signal if the receivable_location detection signal is output in the location detection step and the not_moving detection signal is output in the motion detection step when the external signal is to be received.

25. A reception control program for a radio-controlled timepiece, the reception control program configured to cause a computer, which is incorporated in a radio-controlled timepiece that has a reception unit for receiving an external signal carrying time information and a time display for displaying the time based on a reference signal, to function as a controller having a location detector function for detecting the current location of the radio-controlled timepiece independent of actual reception of the external signal by the reception unit and outputting a location detection signal indicating whether or not the radio-controlled timepiece is estimated to be located where the external signal can be received by the reception unit, wherein the controller controls operation of the time display and controls the reception operation of the reception unit based on the location detection signal.

* * * * *

UNITED STATES PATENT AND TRADEMARK OFFICE

CERTIFICATE OF CORRECTION

PATENT NO. : 7,388,812 B2
APPLICATION NO. : 10/955861
DATED : June 17, 2008
INVENTOR(S) : Hidenori Nakamura It is certified that error appears in the above-identified patent and that said Letters Patent is hereby corrected as shown below:

Column 42, line 15, please change “radio-controlled imepiece” to --radio-controlled timepiece--

Signed and Sealed this

Sixteenth Day of December, 2008

JON W. DUDAS
*Director of the United States Patent and Trademark Office*